US009550384B2

(12) United States Patent
Sakamoto et al.

(10) Patent No.: US 9,550,384 B2
(45) Date of Patent: Jan. 24, 2017

(54) RECORDING APPARATUS

(71) Applicant: SEIKO EPSON CORPORATION, Tokyo (JP)

(72) Inventors: Naoki Sakamoto, Kitakyushu (JP); Ryoichi Shuto, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/737,029

(22) Filed: Jun. 11, 2015

(65) Prior Publication Data

US 2015/0375534 A1 Dec. 31, 2015

(30) Foreign Application Priority Data

Jun. 25, 2014 (JP) ..... 2014-130393

(51) Int. Cl.
*B41J 11/04* (2006.01)
*B41J 29/02* (2006.01)
*B41J 3/36* (2006.01)

(52) U.S. Cl.
CPC ..... *B41J 29/023* (2013.01); *B41J 3/36* (2013.01); *B41J 11/04* (2013.01)

(58) Field of Classification Search
CPC ..... B41J 11/04; B41J 29/023; B41J 3/36
USPC ..... 347/104
See application file for complete search history.

(56) References Cited

U.S. PATENT DOCUMENTS 5,270,735 A * 12/1993 Fiscella ..... B41J 2/325 346/134
2002/0057301 A1* 5/2002 Ikeda ..... B41J 2/04556 347/8
2005/0195242 A1* 9/2005 Samoto ..... B41J 19/00 347/37
2011/0267413 A1* 11/2011 Nakano ..... B41J 13/0045 347/104

FOREIGN PATENT DOCUMENTS

JP 2006-247932 A 9/2006
JP 2007-118442 A 5/2007

* cited by examiner

*Primary Examiner* — Stephen Meier
*Assistant Examiner* — Alexander D Shenderov
(74) *Attorney, Agent, or Firm* — Workman Nydegger

(57) ABSTRACT

Provided is a printer which includes a carriage which includes a recording head performing recording on a paper sheet, a transport driving roller which transports the paper sheet to the recording head side and is driven by a driving source, and a transport driven roller which is pressed to the transport driving roller, is rotationally driven in contact with the paper sheet, and has a diameter larger than that of the transport driving roller. The transport driving roller is located below a guide frame as a support member supporting the carriage and is located in an area of the guide frame in a paper transport direction (in other words, a y direction).

6 Claims, 23 Drawing Sheets

RECORDING APPARATUS

BACKGROUND

1. Technical Field

The present invention relates to a recording apparatus represented by a facsimile or a printer.

2. Related Art

In an ink jet printer as an example of a recording apparatus, a pair of transport rollers which transport a recording paper sheet as an example of a medium is provided on an upstream side of a recording head. Generally, the pair of transport rollers is constituted of a driving roller driven by a motor and a driven roller pressed to the driving roller.

There is a so-called serial-type printer in which a carriage including a recording head can move in a scanning direction of the recording head. In such a serial-type printer, the carriage is supported by a support member (in other words, a guide member) and is guided in the scanning direction of the recording head. An example of such a serial-type recording apparatus is disclosed in JP-A-2006-247932.

Examples of the support member supporting the carriage include a shaft-shaped member and a plate-shaped member as disclosed in JP-A-2006-247932. In this specification, the support member includes, in addition to the shaft-shaped member and the plate-shaped member disclosed in JP-A-2006-247932, members of every types which extend in a carriage movement direction, regardless of the shape thereof, and support the carriage.

Meanwhile, it is necessary to further reduce the size of a printer. Particularly, in a case of a mobile-type printer which may be carried by a user, it is necessary to further reduce the size thereof.

In a case of a printer of the related art disclosed in JP-A-2006-247932, in other words, a printer including a support member which supports a carriage and guides the carriage in a scanning direction of a recording head and a pair of transport rollers, particularly, a reduction in the size of an apparatus in a depth direction is not necessarily considered in view of such a size reduction request.

SUMMARY

An advantage of some aspects of the invention is to further reduce the size of a recording apparatus including a support member and a pair of transport rollers.

According to an aspect of the invention, there is provided a recording apparatus including: a carriage which includes a recording head performing recording on a medium and can move in a predetermined direction; a support member which extends in a carriage movement direction and supports the carriage; a driving roller which transports the medium to the recording head side and is driven by a driving source; and a driven roller which is pressed to the driving roller and is rotationally driven in contact with the medium, in which the driving roller is located below the support member and located in an area of the support member in a medium transport direction.

In this case, the driving roller which transports the medium to the recording head side and is driven by the driving source is located below the support member supporting the carriage and is located, in the medium transport direction, in the area of the support member. Thus, the size of the driving roller and the size of the support member are not separately added in terms of the size of the apparatus in the medium transport direction. As a result, the size of the apparatus in the medium transport direction can be reduced.

Furthermore, the recording head and the components in the vicinity of the recording head can be located close to the upstream side in the medium transport direction, and thus the size of the apparatus in the medium transport direction can be reduced.

In the recording apparatus, it is preferable that a diameter of the driven roller is larger than that of the driving roller.

In this case, the diameter of the driven roller is larger than that of the driving roller, and thus the following effects can be obtained. In other words, in a case where the medium is transported by the driving roller and the driven roller, when the following edge of the medium is discharged from the rollers, the following edge is forcefully sent out. As a result, in some cases, a transport accuracy reduction phenomenon, in other words, a so-called kick-off phenomenon, occurs.

In this case, the following edge of the medium is pushed out from the portion between the driven roller and the driving roller. However, in this case, a pushing force in accordance with pressing of the driven roller is set as follows. A pushing force by the driving roller having a relatively small diameter is larger than a pushing force by the driven roller having a relatively large diameter.

In this case, when the following edge of the medium is pushed out from the portion between the driven roller and the driving roller, the driven roller can freely rotate. Thus, rotation of the driven roller acts on the following edge of the medium so that the rotation causes the following edge of the medium to be forcefully pushed out. However, the driving roller is connected to a power source and cannot freely rotate. Thus, upon comparison with the driven roller, the driving roller does not operate in such a way that the driving roller causes the following edge of the medium to be forcefully pushed out.

In this case, the property described above is used. Accordingly, in a case of the driven roller which is operated so that the driven roller forcefully pushes out the following edge of the medium, the driven roller has a diameter larger than that of the driving roller so that the pushing force in accordance with pressing is relatively small. As a result, a kick-off phenomenon can be appropriately prevented with a simple configuration.

In the recording apparatus, it is preferable that the driven roller is located below the support member and is located in the area of the support member in the medium transport direction. Furthermore, it is preferable that the driving roller is located below the driven roller and is located in the area of the driven roller in the medium transport direction.

In this case, the driven roller is located below the support member and is located in the area of the support member in the medium transport direction. Furthermore, the driving roller is located below the driven roller and is located in the area of the driven roller in the medium transport direction. As a result, the size of the driving roller, the size of the driven roller, and the size of the support member are not separately added in terms of the size of the apparatus in the medium transport direction, and thus the size of the apparatus in the medium transport direction can be more favorably reduced.

In the recording apparatus, it is preferable that a roller shaft support member which pivotally supports the driven roller is provided and at least a part of the support member and at least a part of the roller shaft support member are located at the same vertical position.

In this case, a roller shaft support member which pivotally supports the driven roller is provided and at least a part of the support member and at least a part of the roller shaft support member are located at the same vertical position. As a result, the size of the roller shaft support member and the size of the support member are not separately added in terms of the size of the apparatus in the height direction, and thus the size of the apparatus in the height direction can be reduced.

In the recording apparatus, it is preferable that a medium support member supporting the medium is provided at a position capable of facing the recording head. Furthermore, it is preferable that the medium sent from the portion between the driving roller and the driven roller is pressed to the medium support member.

In this case, the medium support member supporting the medium is provided at the position capable of facing the recording head and the medium sent from the portion between the driving roller and the driven roller is pressed to the medium support member. As a result, floating of the medium is effectively prevented at a position facing the recording head.

In the recording apparatus, it is preferable that the driving roller is formed by attaching particles to the outer circumferential surface of a solid shaft or a hollow shaft. Furthermore, it is preferable that the driven roller is formed of a resin material.

In the recording apparatus, it is preferable that a rotation detection unit for detecting rotation of the driving roller is provided. Furthermore, it is preferable that the rotation detection unit includes a rotary scale and a detector for detecting rotation of the rotary scale. In addition, it is preferable that the rotary scale is attached to the driving roller.

In the recording apparatus, it is preferable that the support member is constituted of a frame material.

When it is assumed that the support member is constituted of a shaft body, it is necessary to provide a bearing to receive the shaft body. Thus, the size of the apparatus in the carriage movement direction is increased by the size of the bearing. However, in this case, the support member is constituted of a frame material, and thus an increase in the size of the apparatus in the carriage movement direction can be prevented.

It is preferable that the recording apparatus further includes a discharge roller which is located downstream from the recording head in a medium transport direction and discharges the medium, in which the carriage has the support member used as a first frame material and is supported by the first frame material and a second frame material which is disposed downstream from the recording head in the medium transport direction, and the discharge roller is located below the second frame material.

In this case, the discharge roller is located below the second frame material. As a result, the size of the discharge roller and the size of the second frame material are not separately added in terms of the size of the apparatus in the medium transport direction, and thus the size of the apparatus in the medium transport direction can be reduced.

BRIEF DESCRIPTION OF THE DRAWINGS

The invention will be described with reference to the accompanying drawings, wherein like numbers reference like elements.

FIGS. 23A and 23B are explanatory views of a principle of pushing-out of a following edge of a paper sheet by the transport driving roller and the transport driven roller, in which FIG. 23A illustrates a case of the embodiment and FIG. 23B illustrates a case of the related art.

DESCRIPTION OF EXEMPLARY EMBODIMENTS

Hereinafter, an embodiment of the invention will be described with reference to the accompanying drawings. However, the invention is not limited to the embodiment described below. The embodiment can be modified in various ways as long as they are within the scope of the invention described in the claims. The embodiment of the invention will be described with a precondition that the modified embodiments are included in the scope of the invention.

Figure 1:
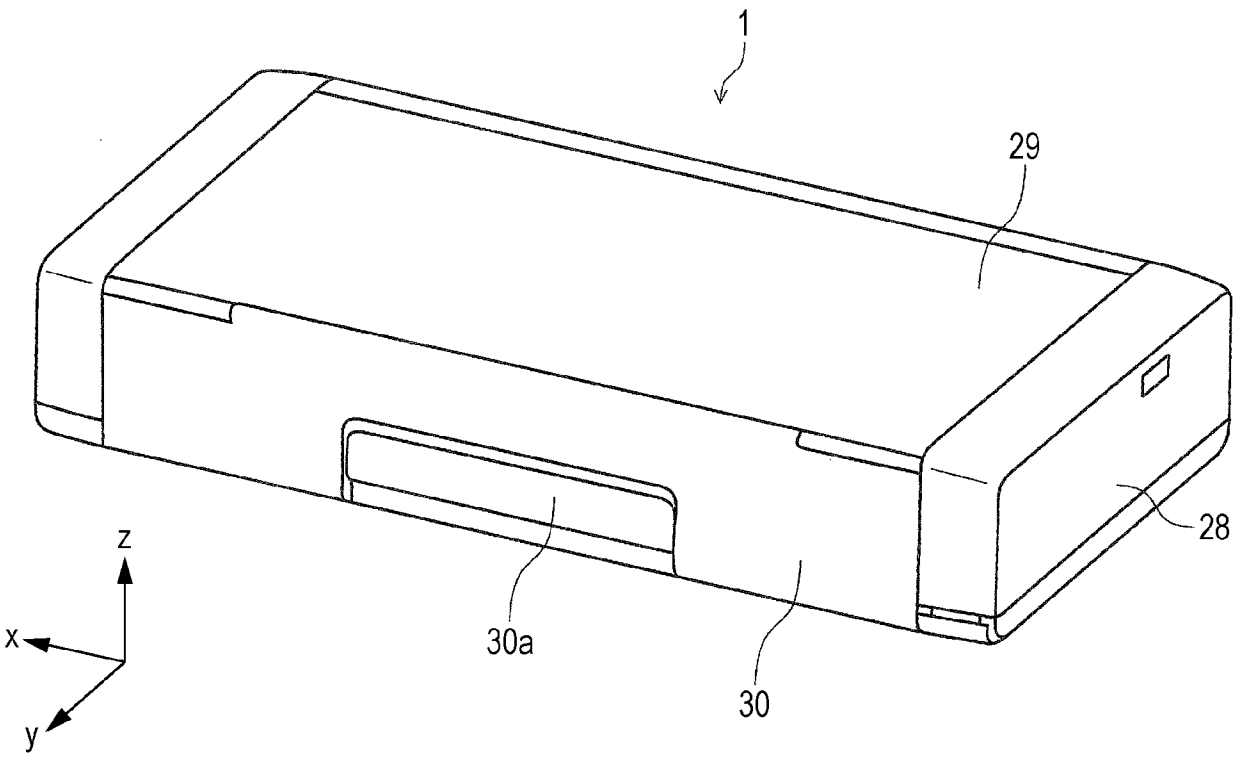
FIG. 1 is a perspective view of an external appearance of a printer according to the invention.
Figure 2:
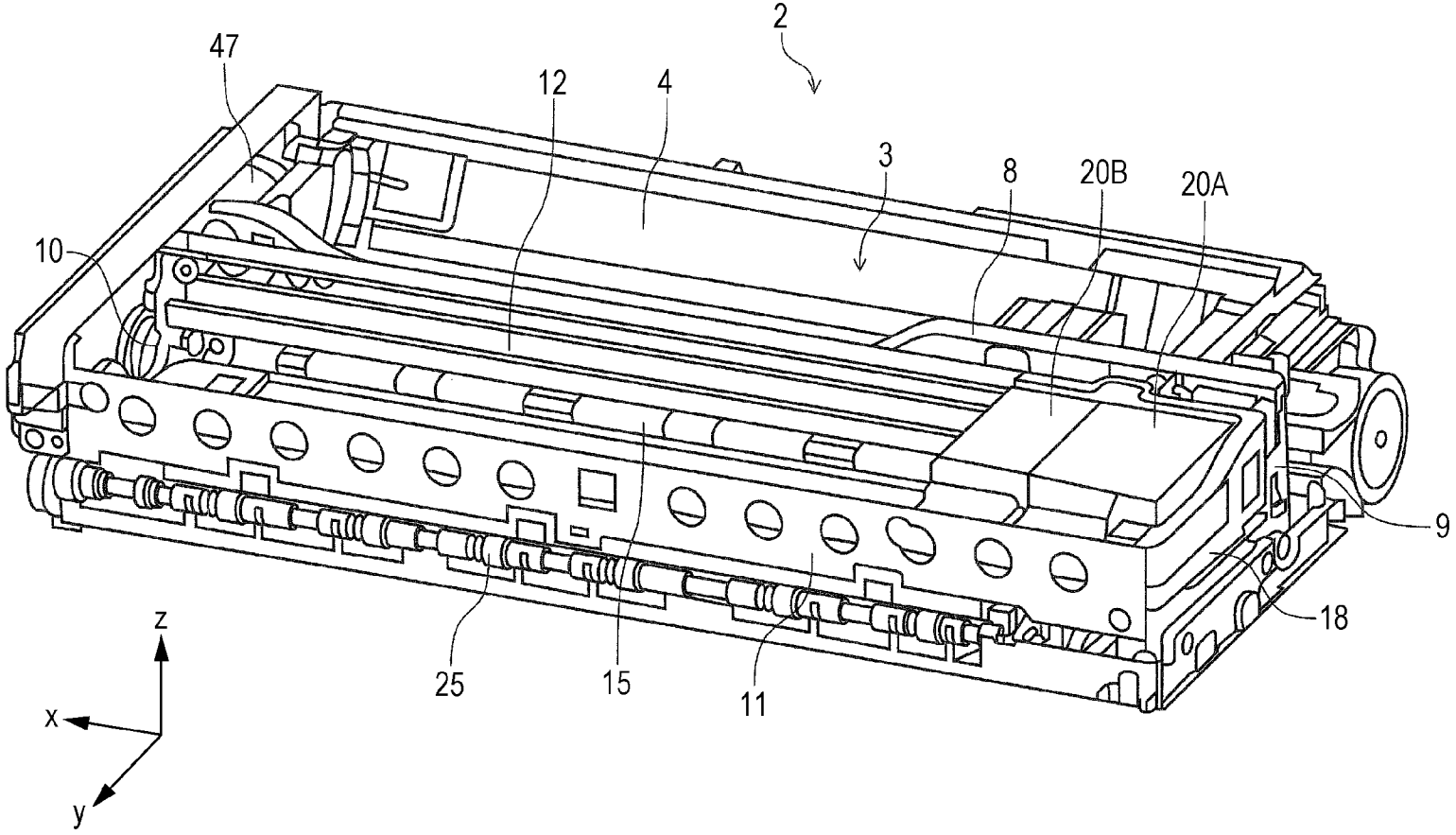
FIG. 2 is a perspective view of an apparatus main body of the printer according to the invention.
Figure 3:
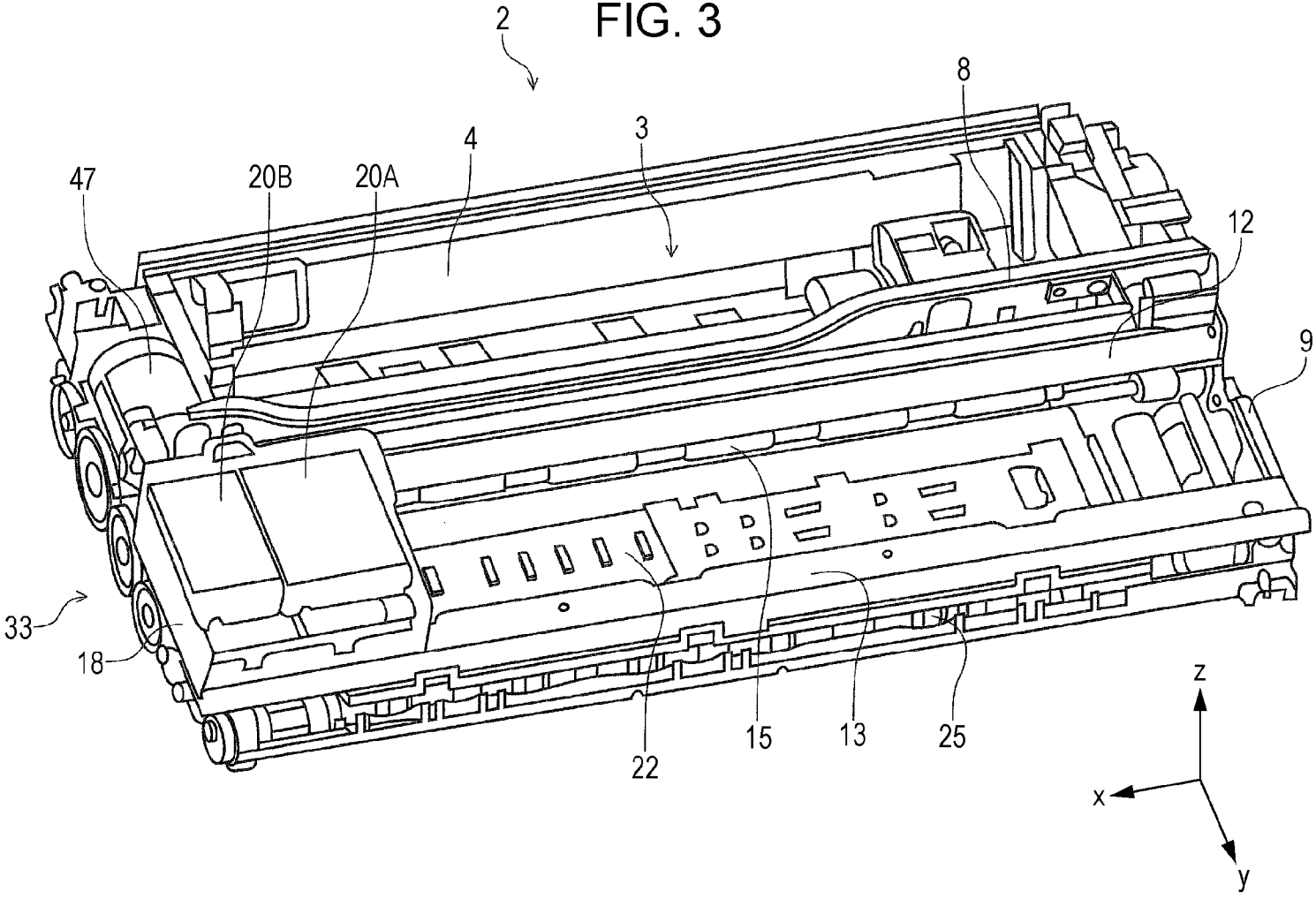
FIG. 3 is perspective view of the apparatus main body of the printer according to the invention.
Figure 4:
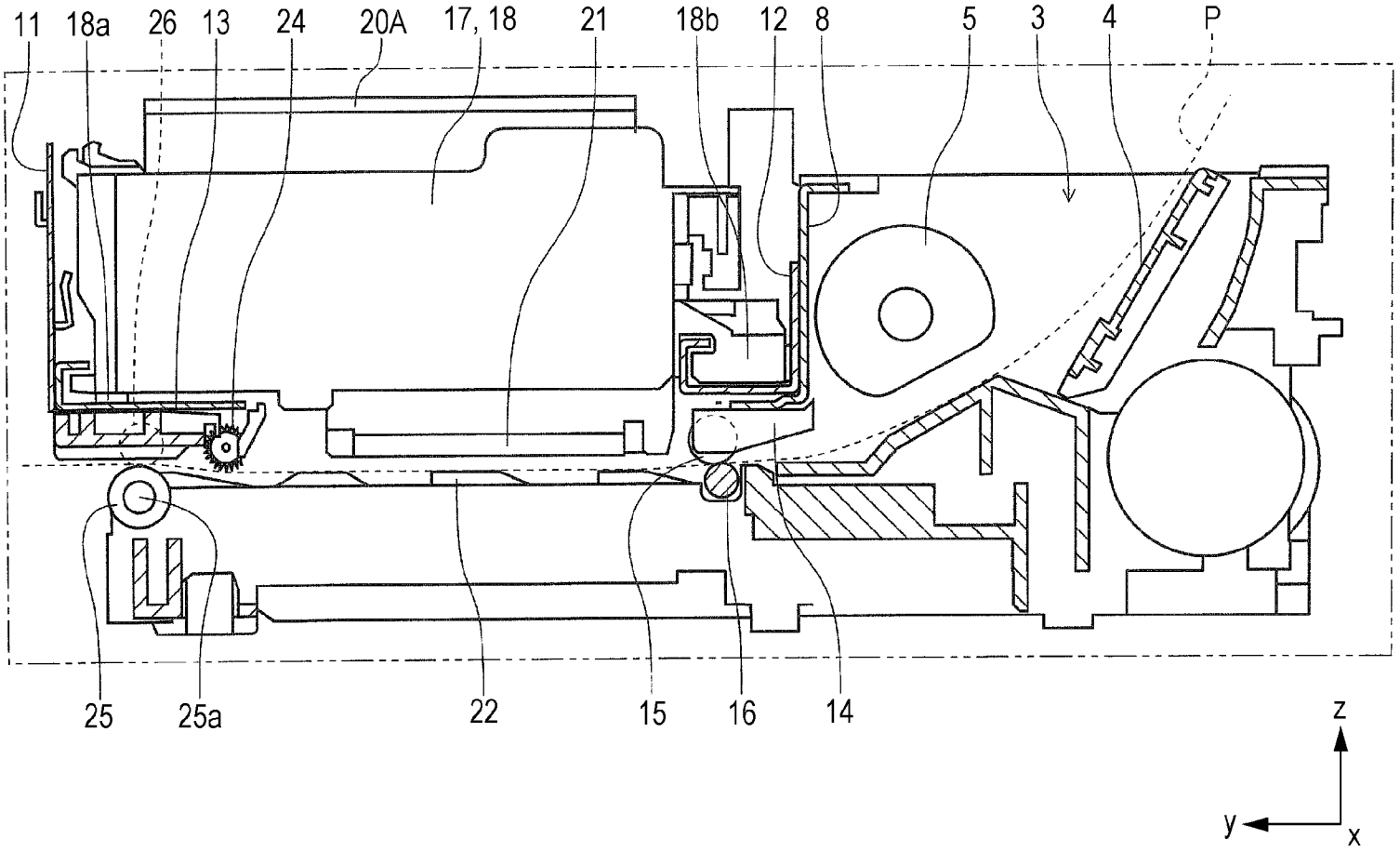
FIG. 4 is a lateral cross-sectional view illustrating a paper transport path of the printer according to the invention.
Figure 5:
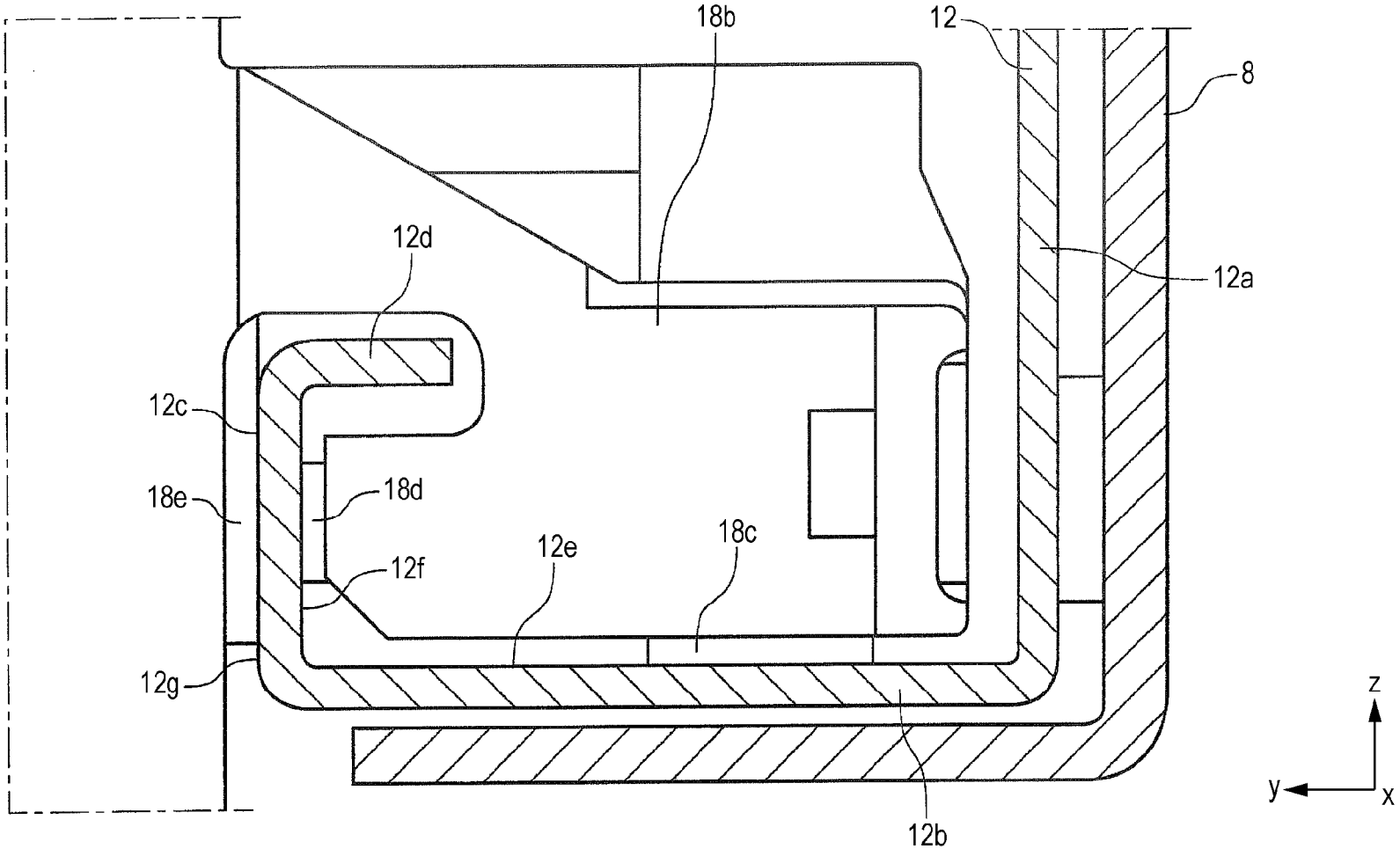
FIG. 5 is a partially enlarged view of FIG. 4.
Figure 6:
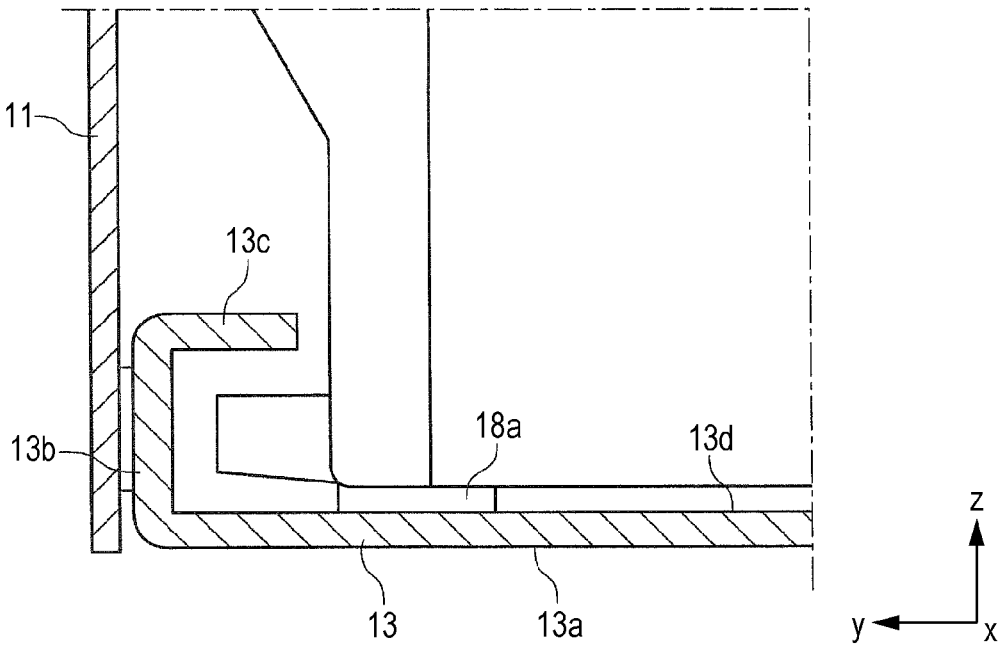
FIG. 6 is a partially enlarged view of FIG. 4.

FIG. 1 is a perspective view of an external appearance of an ink jet printer (hereinafter, referred to as a "printer") 1 as an embodiment of a "recording apparatus" according to the invention. FIGS. 2 and 3 are perspective views of an apparatus main body (in a state where a casing body forming the external appearance is removed) 2. FIG. 4 is a lateral cross-sectional view illustrating a paper transport path of the printer 1 according to the invention. FIGS. 5 and 6 are partially enlarged views of FIG. 4.

Figure 7:
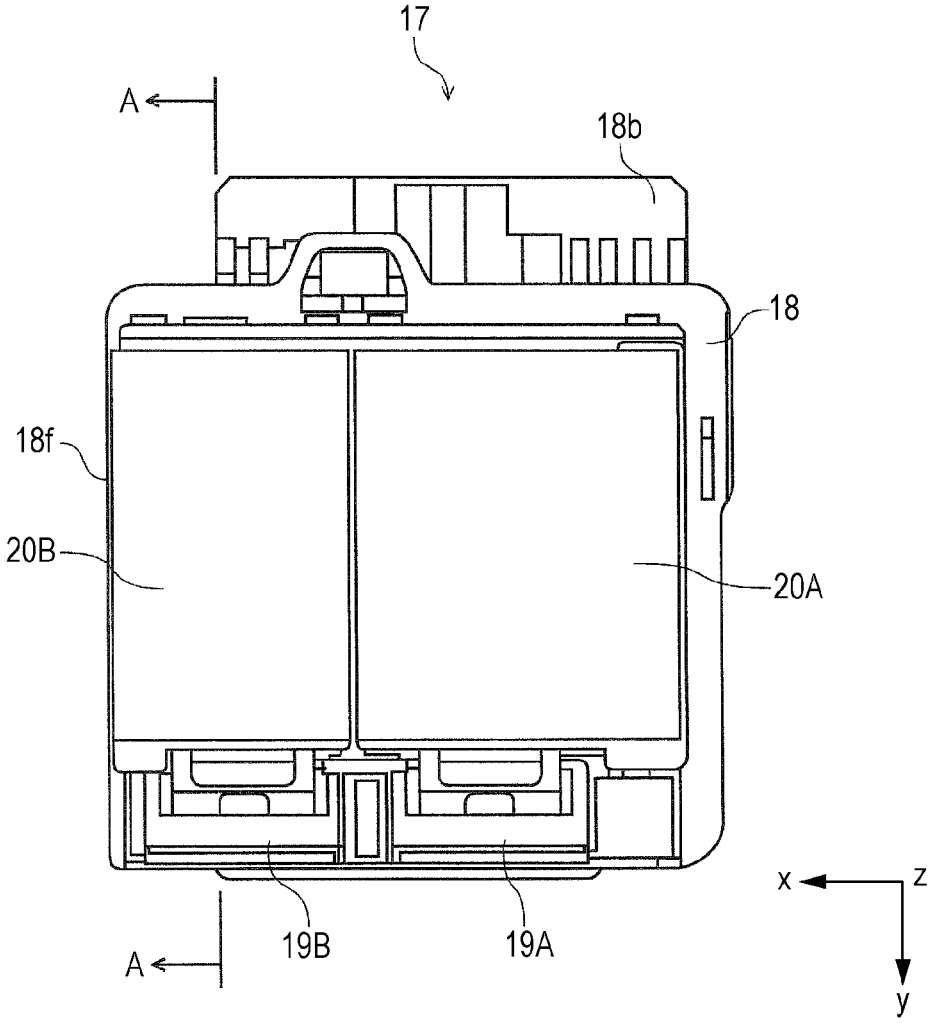
FIG. 7 is a plan view of a carriage when seen from above.
Figure 8:
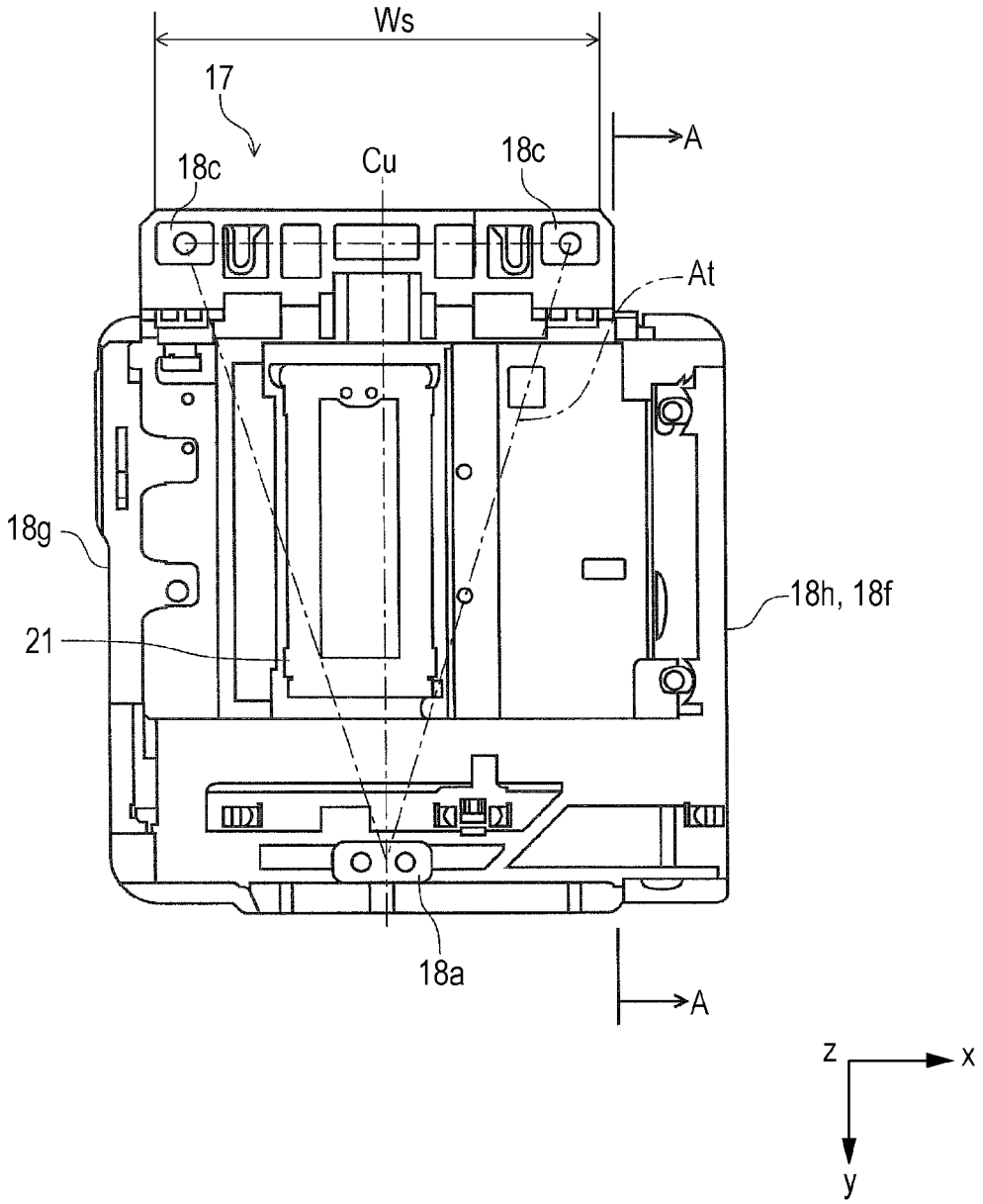
FIG. 8 is a plan view of the carriage when seen from below.
Figure 9:
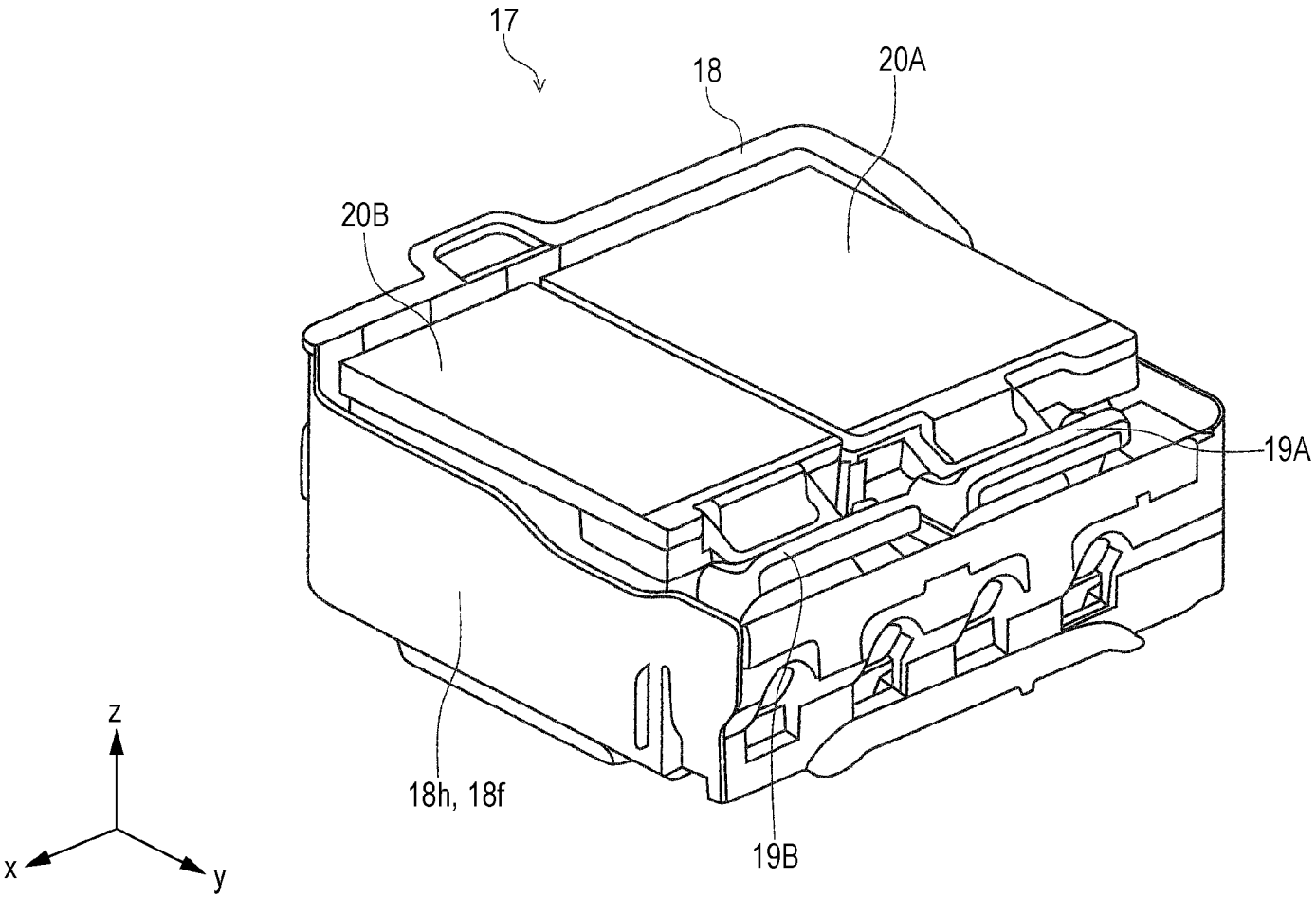
FIG. 9 is a perspective view of the carriage when seen obliquely from above on a front side of an apparatus.
Figure 10:
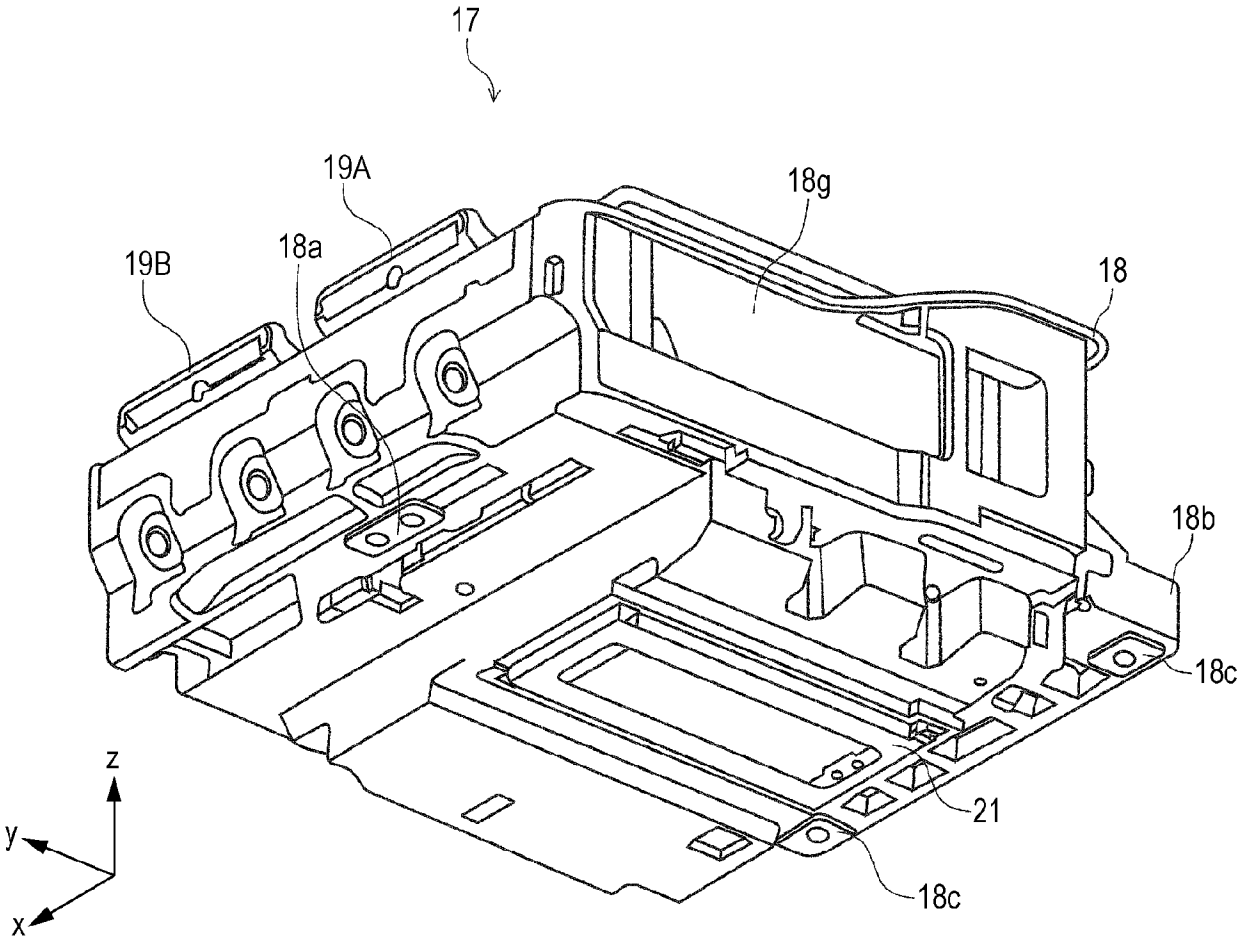
FIG. 10 is a perspective view of the carriage when seen obliquely from below on the front side of the apparatus.
Figure 11:
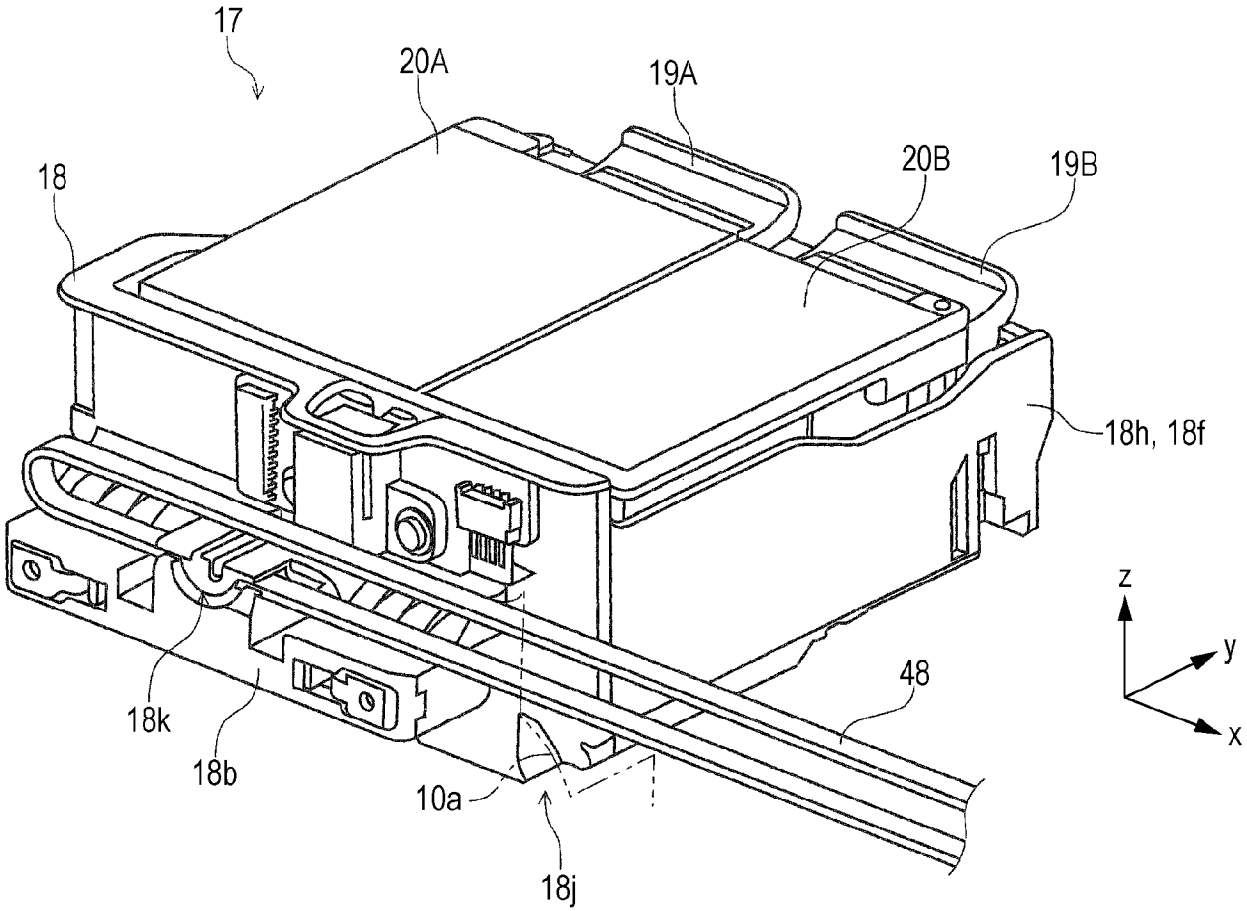
FIG. 11 is a perspective view of the carriage when seen obliquely from above on a rear side of the apparatus.
Figure 12:
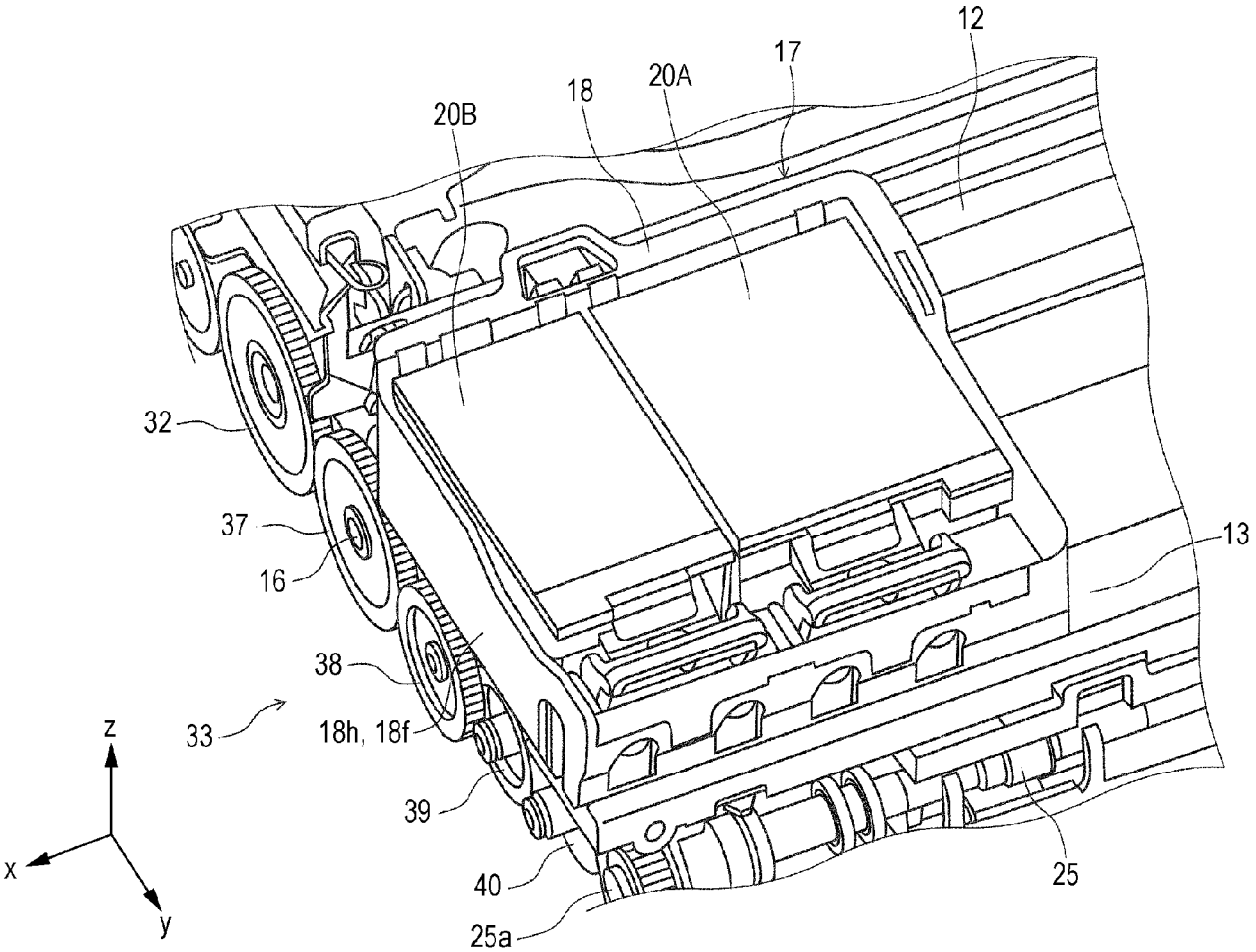
FIG. 12 is a perspective view illustrating a state in which the carriage is located at a left end portion.
Figure 13:
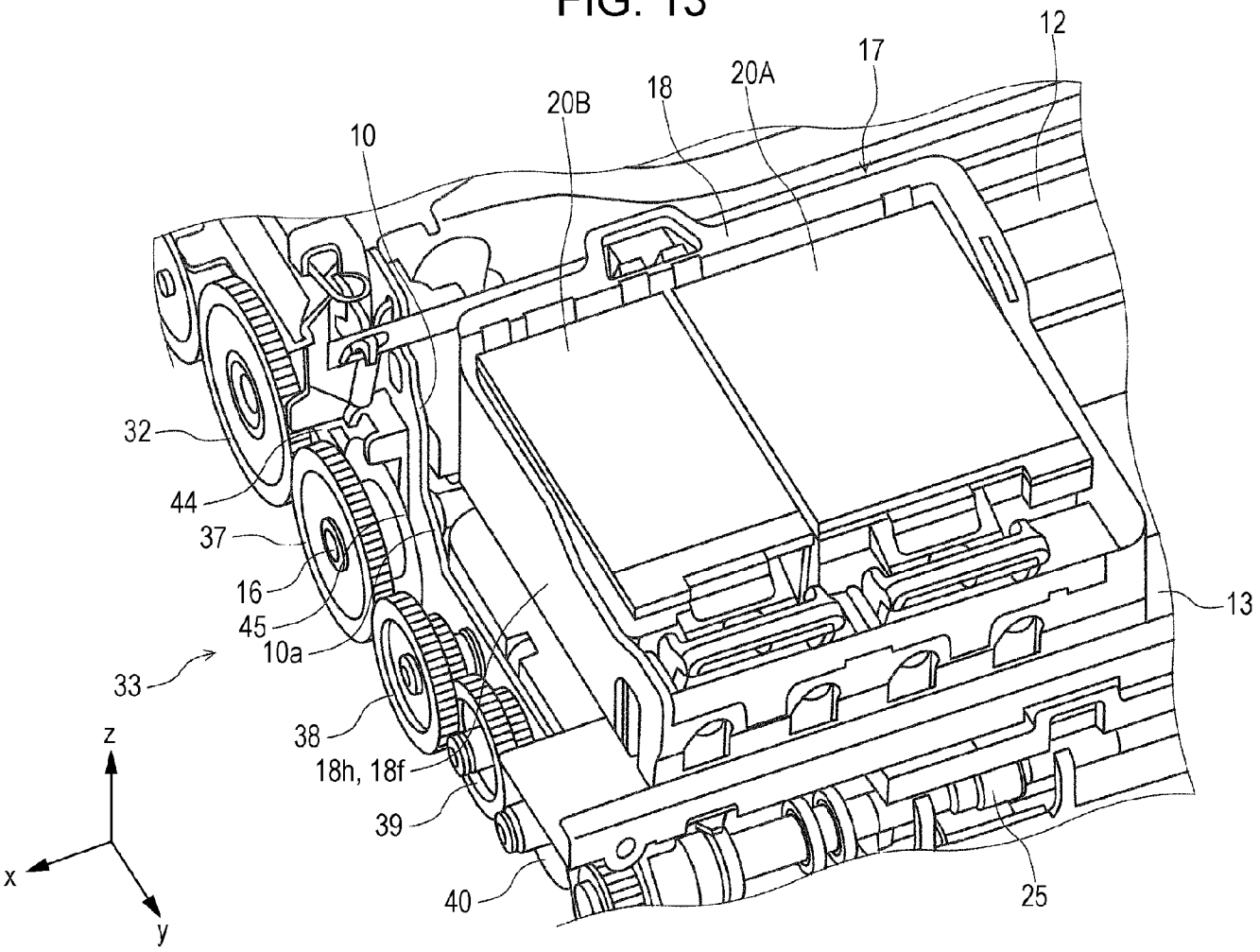
FIG. 13 is a perspective view illustrating a state where the carriage is located at a position slightly closer to a home position than the left end portion.
Figure 14:
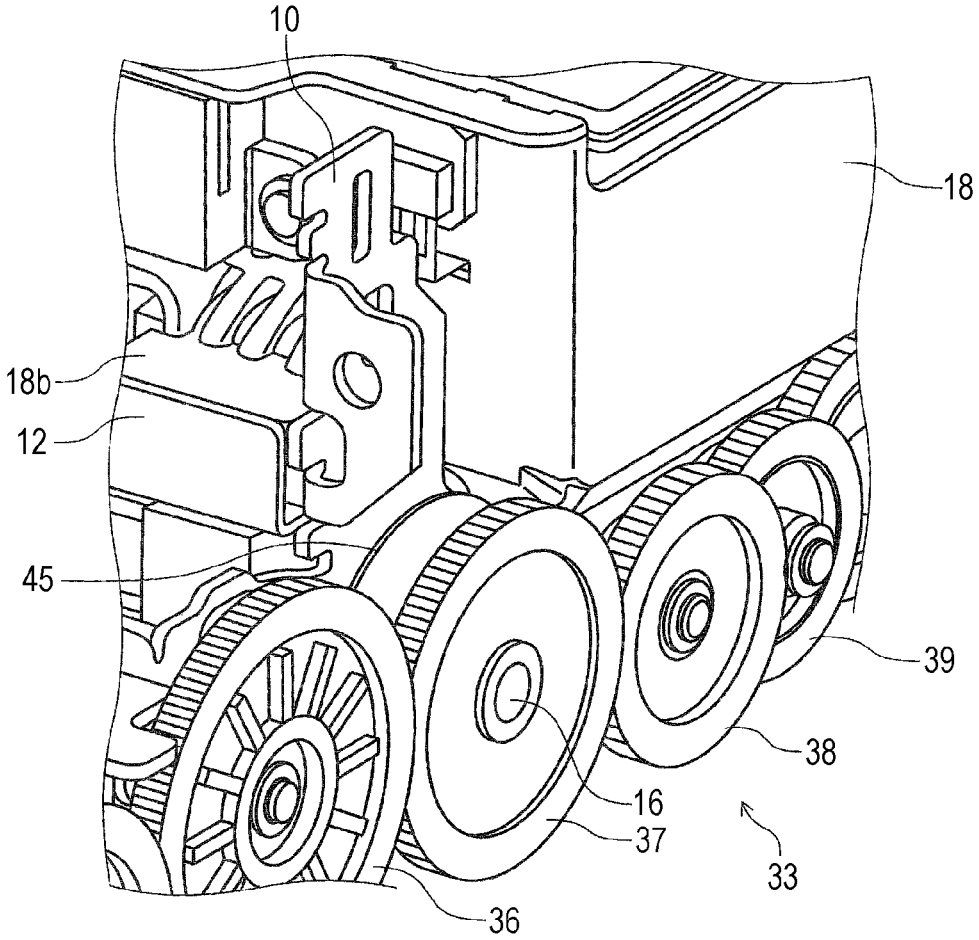
FIG. 14 is a perspective view illustrating a gear group and a rotary scale.
Figure 15:
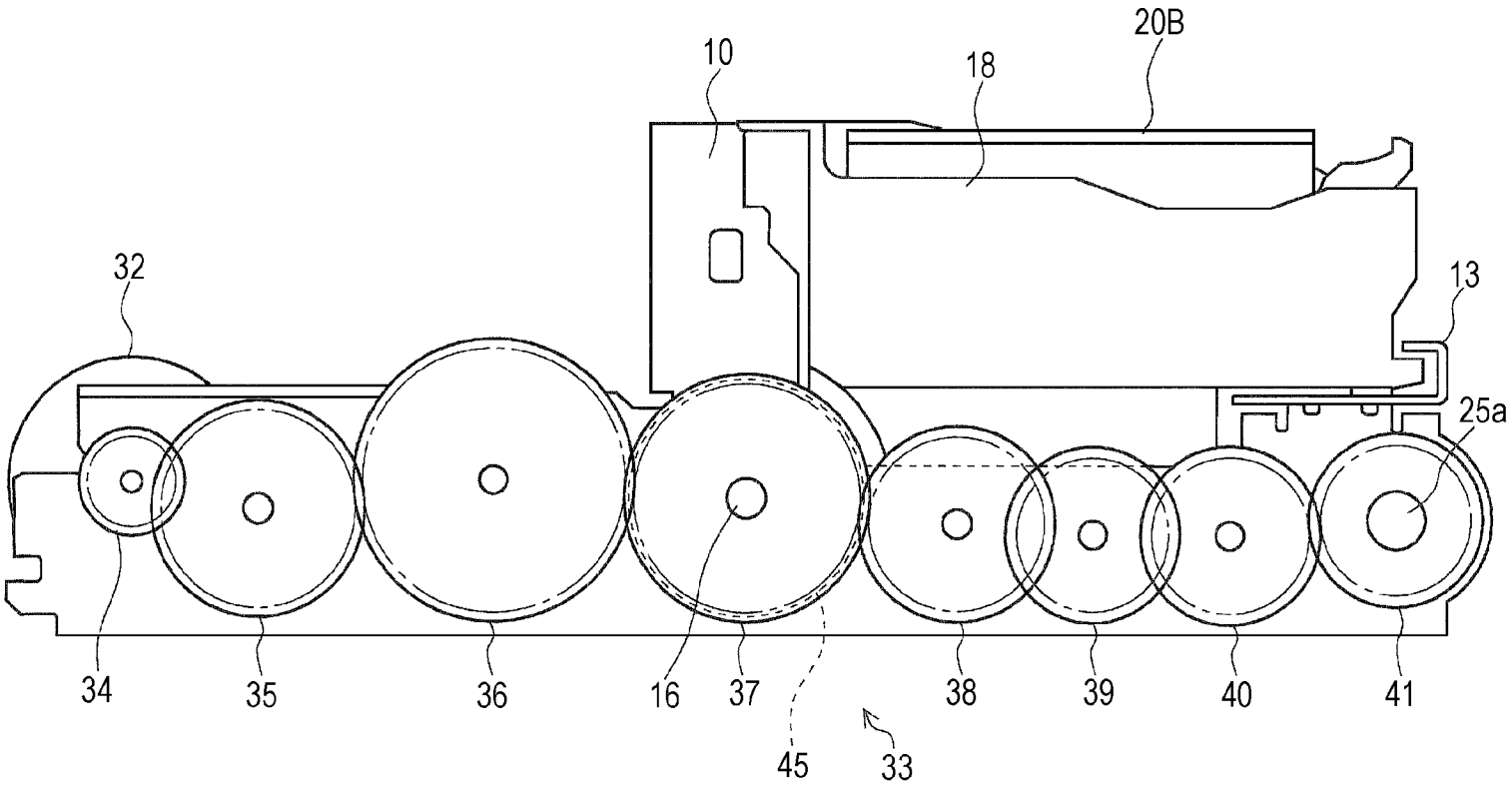
FIG. 15 is a front view of the gear group.
Figure 16:
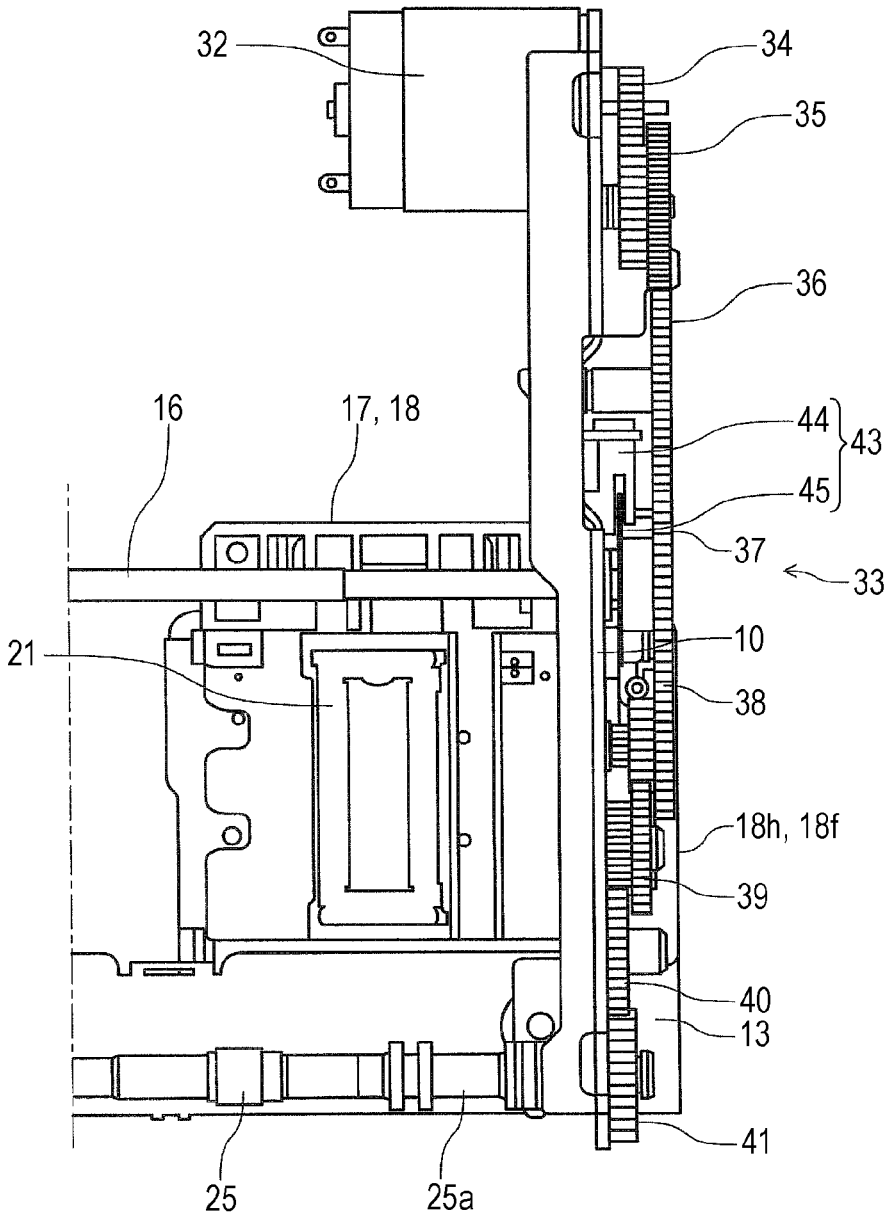
FIG. 16 is a plan view of the gear group and the carriage when seen from below.

Furthermore, FIG. 7 is a plan view of a carriage 17 when seen from above. FIG. 8 is a plan view of the carriage 17 when seen from below. FIG. 9 is a perspective view of the carriage 17 when seen obliquely from above on a front side of an apparatus. FIG. 10 is a perspective view of the carriage 17 when seen obliquely from below on the front side of the apparatus. FIG. 11 is a perspective view of the carriage 17 when seen obliquely from above on a rear side of the apparatus. FIG. 12 is a perspective view illustrating a state in which the carriage 17 is located at a left end portion. FIG. 13 is a perspective view illustrating a state where the carriage 17 is located at a position slightly closer to a home position than the left end portion. In addition, FIG. 14 is a perspective view illustrating a gear group 33 and a rotary scale 45. FIG. 15 is a front view of the gear group 33. FIG. 16 is a plan view of the gear group 33 and the carriage 17 when seen from below.

Figure 17A:
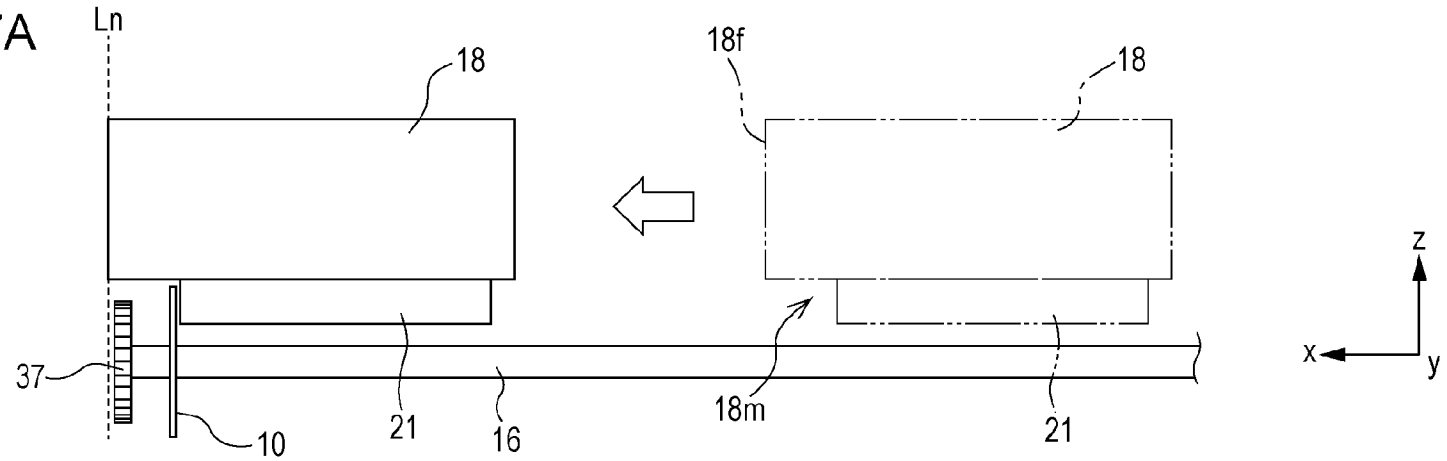
FIGS. 17A and 17B are schematic views illustrating variations of a position of a gear in relation to the carriage.
Figure 17B:
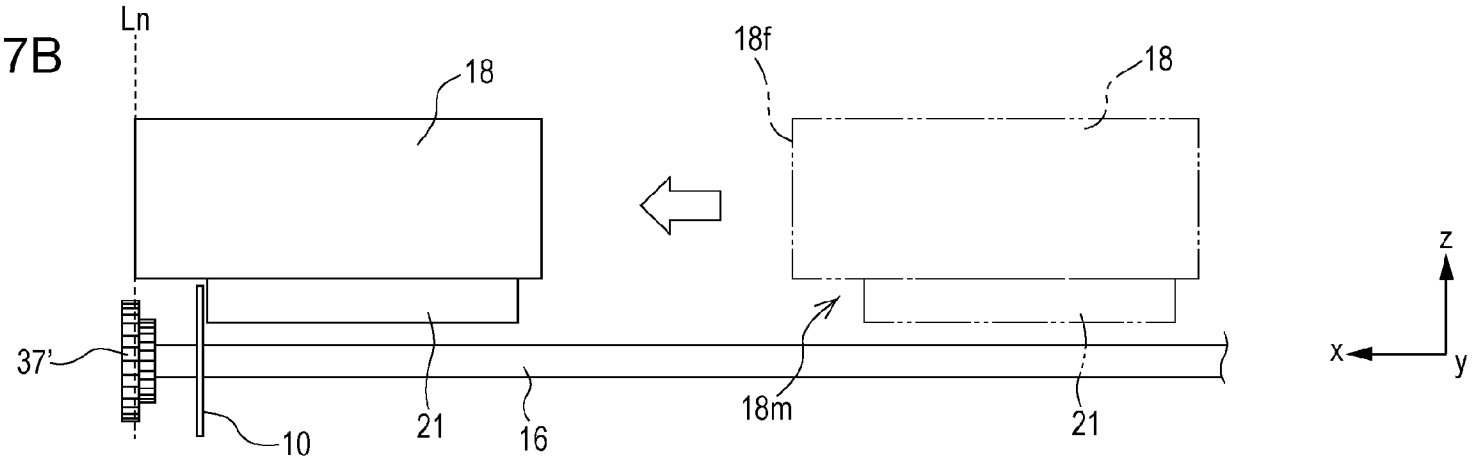
Figure 18:
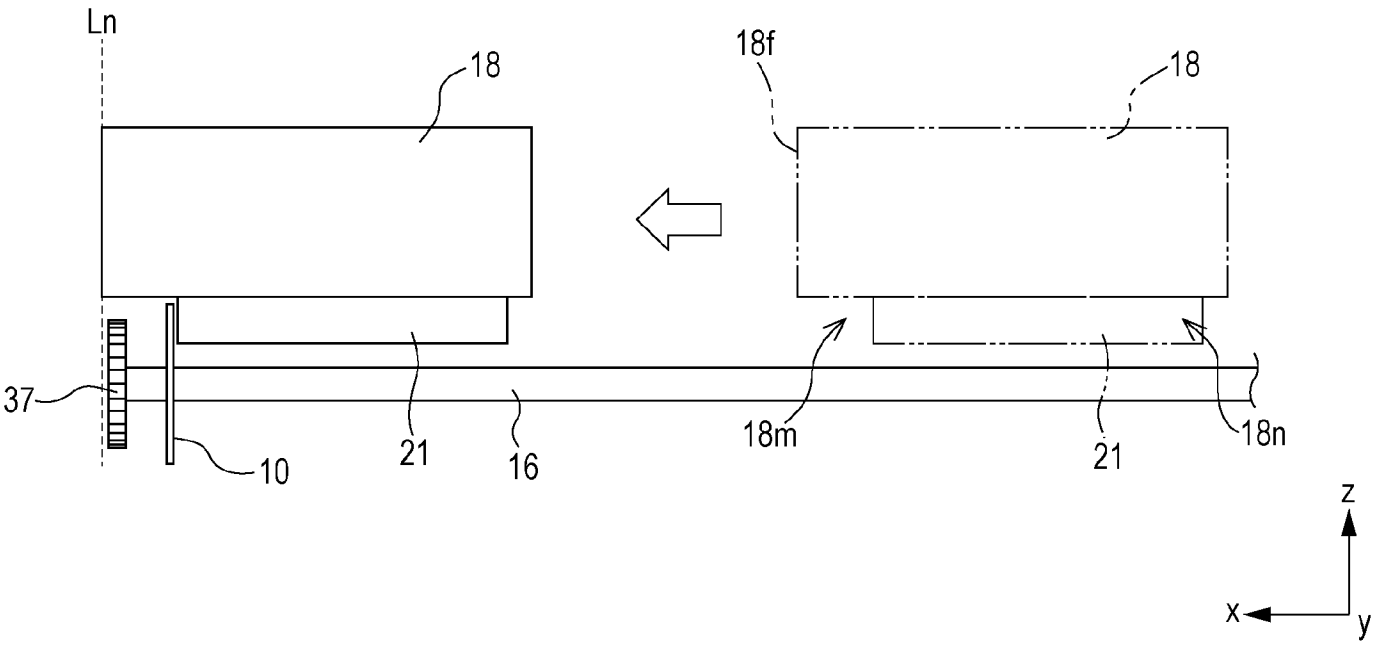
FIG. 18 is a schematic view illustrating another embodiment of the carriage.
Figure 19:
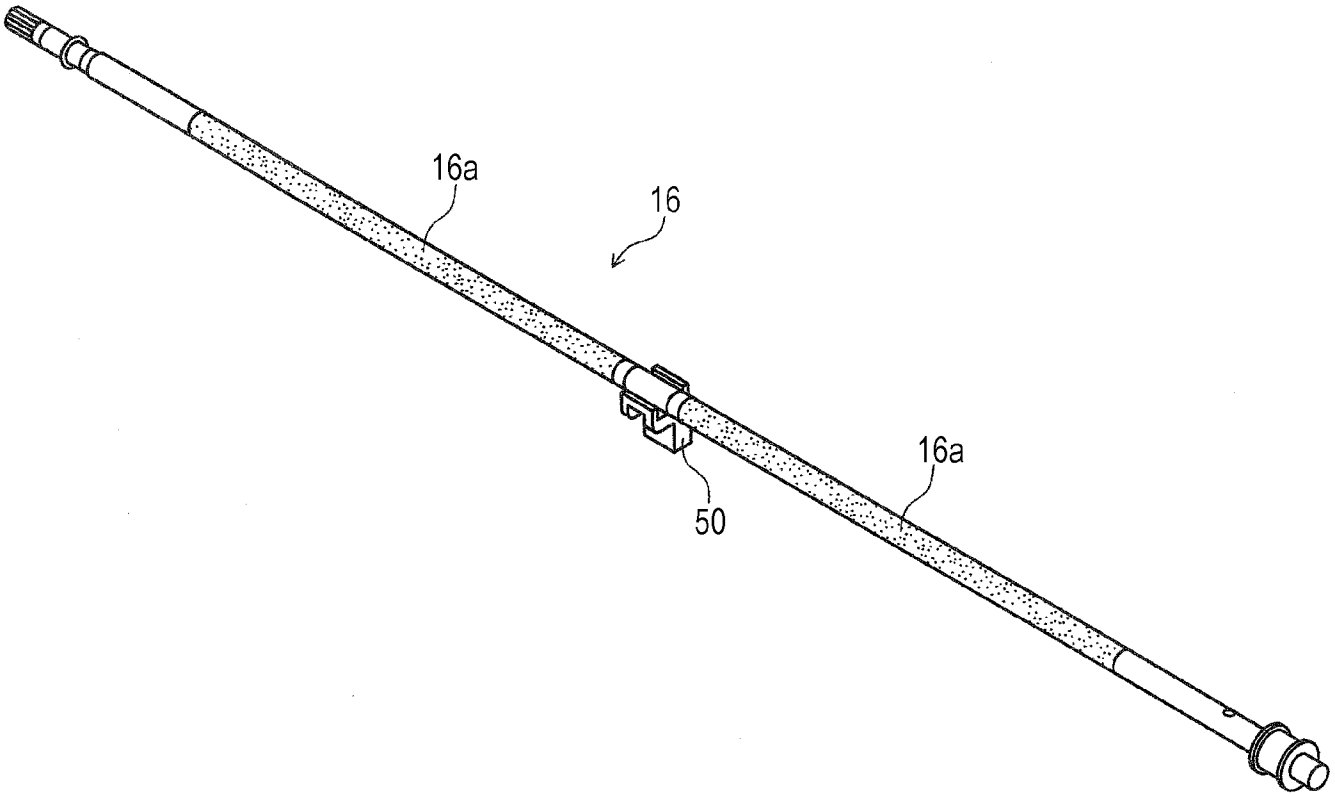
FIG. 19 is a perspective view of a transport driving roller.
Figure 20:
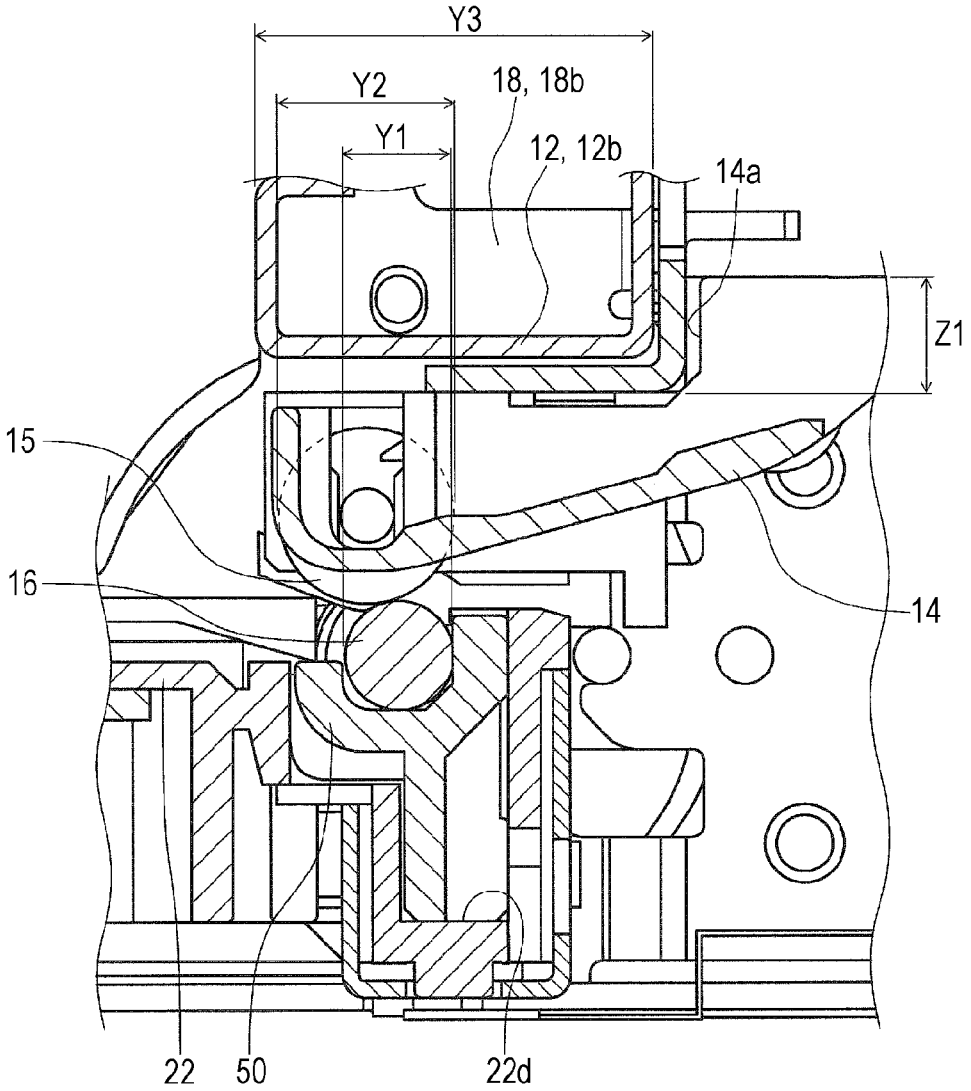
FIG. 20 is a cross-sectional view of the transport driving roller and a central support member.
Figure 20:
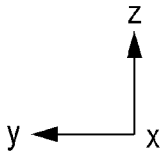
Figure 21:
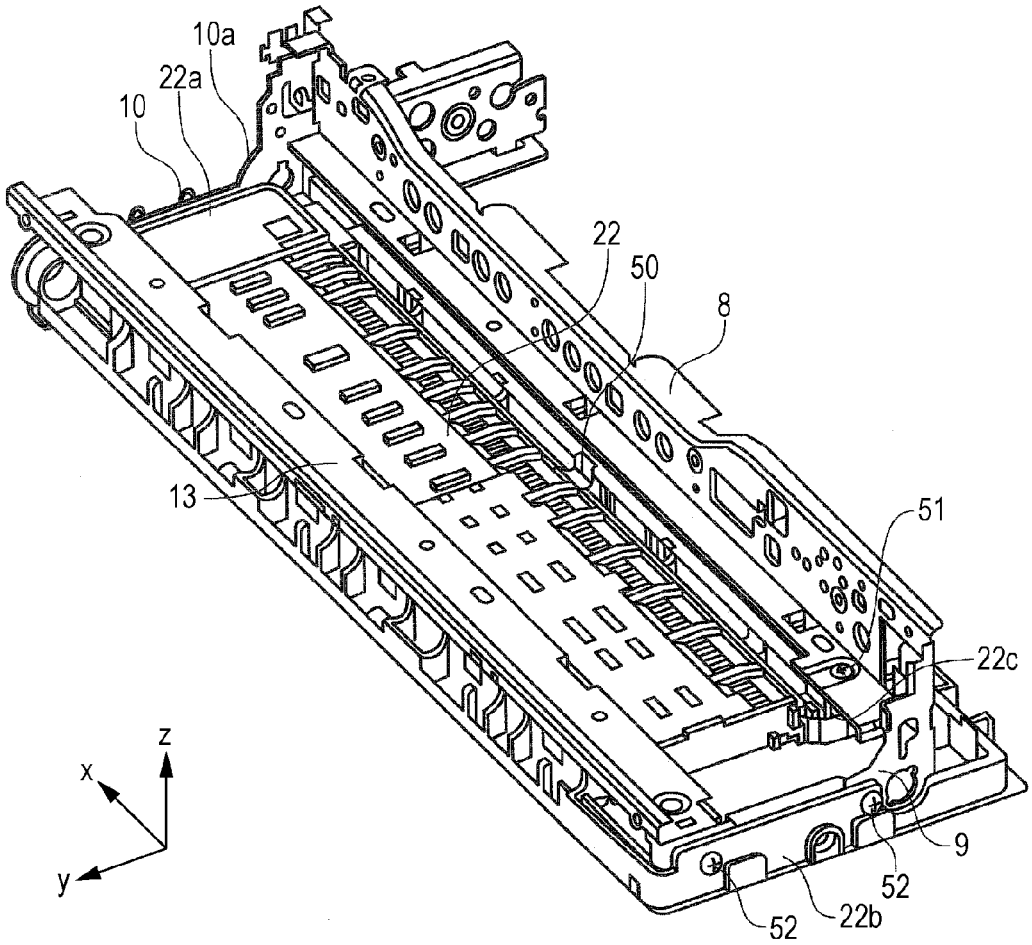
FIG. 21 is a perspective view of a main frame, a side frame, a guide frame, and a paper support member.
Figure 22:
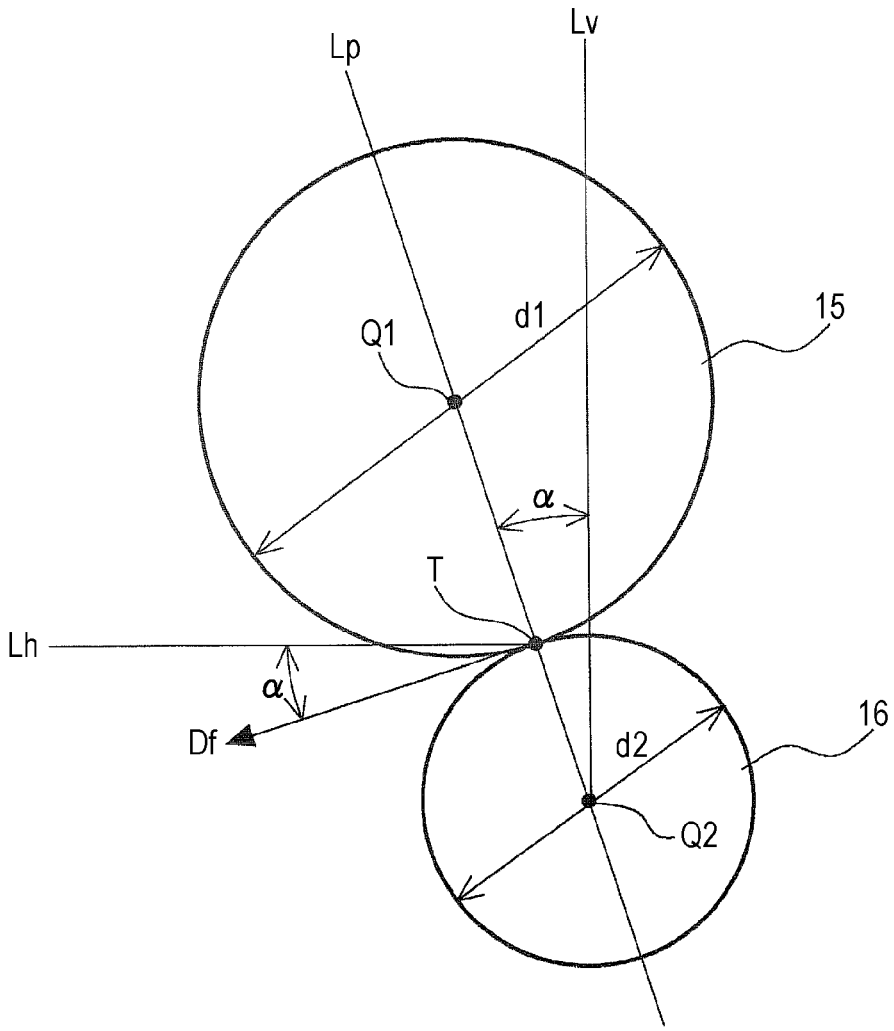
FIG. 22 is a view illustrating a positional relationship between the transport driving roller and a transport driven roller.
Figure 23A:
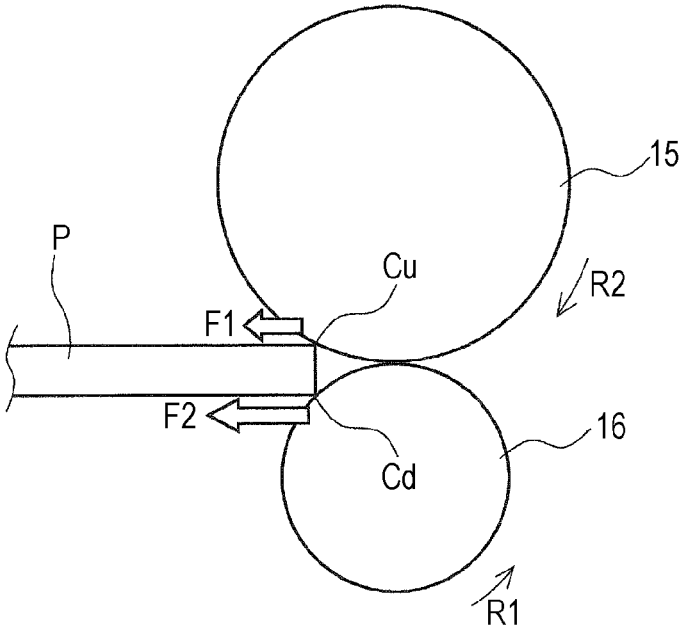
Figure 23B:
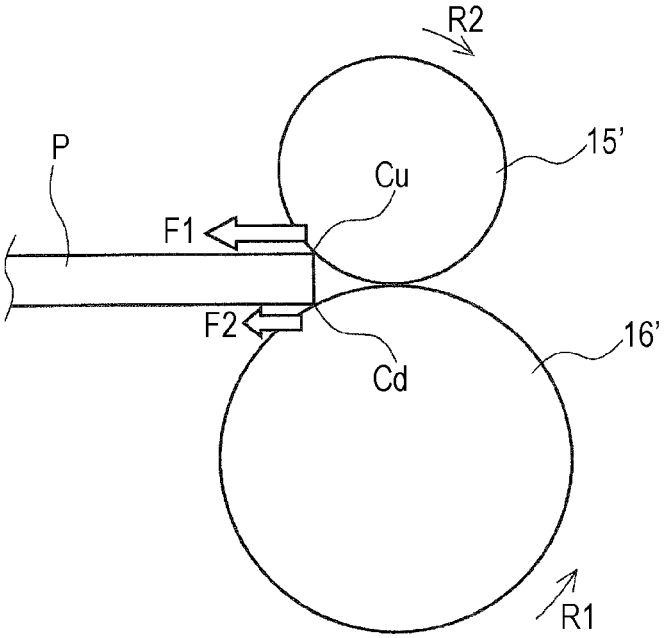

FIGS. 17A and 17B are schematic views illustrating variations of a position of a gear in relation to the carriage 17. FIG. 18 is a schematic view illustrating another embodiment of the carriage. FIG. 19 is a perspective view of a transport driving roller 16. FIG. 20 is a cross-sectional view of the transport driving roller 16, a paper support member 22, and a central support member 50. FIG. 21 is a perspective view of a main frame 8, side frames 9 and 10, a guide frame 13, and the paper support member 22. FIG. 22 is a view illustrating a positional relationship between the transport driving roller 16 and a transport driven roller 15. FIGS. 23A and 23B are explanatory views illustrating a principle of extrusion of a following edge of a paper sheet by the transport driving roller 16 and the transport driven roller 15. FIG. 23A illustrates a case of the embodiment and FIG. 23B illustrates a case of the related art.

Furthermore, in an x-y-z rectangular coordinate system illustrated in each drawing, an x direction and a y direction are horizontal directions. The x direction is a direction (in other words, a paper width direction) perpendicular to a paper transport direction. The x direction is also a right-left direction of the apparatus. Also, the x direction is a movement direction (in other words, a main scanning direction) of the carriage 17. The y direction is the paper transport direction. Also, the y direction is a depth direction of the apparatus. Furthermore, a z direction is a gravity direction. Also, the z direction is a height direction of the apparatus.

Hereinafter, the entirety of the configuration of the printer 1 will be described with reference to FIGS. 1 to 5. The printer 1 is an ink jet printer of a so-called serial type in which recording is operated by alternately performing a recording operation and a paper transport operation. The printer 1 is configured to have a small size in consideration of portability. In FIG. 1, the reference numeral 28 indicates a casing body which forms the external appearance of the apparatus and is constituted of a resin material. The reference numeral 29 indicates an upper cover which is constituted of a resin material, similar to the casing body. The reference numeral 30 indicates a front cover which is constituted of a resin material, similar to the casing body and the upper cover. An upper cover 29 and a front cover 30 are integrally formed. When the upper cover 29 and the front cover 30 are open, an operation panel (not illustrated) and a paper feeding port (not illustrated) are exposed to an upper surface of the apparatus and a paper discharge port is exposed to a front surface of the apparatus. The reference numeral 30*a* indicates an operation lever which releases locking of the front cover 30.

The apparatus main body 2 illustrated in FIGS. 2 and 3 forms the inner side of a casing body 28 described above. The framework of the apparatus main body 2 is constituted of a plurality of frames. Specifically, the frame of the apparatus main body 2 is constituted of a main frame 8, a side frame 9, a side frame 10, a sub-frame 11, a guide frame 12, and a guide frame 13 (each of which will be described in detail).

A feeding port 3 in which a recording paper sheet (which is mainly a cut paper sheet: hereinafter, referred to as a "paper sheet P") as an example of a medium can be set is provided on the rear side of the apparatus. A plurality of paper sheets P sets in the feeding port 3 is supported in an inclined state, by a hopper 4 and a paper support (not illustrated) located above the hopper 4.

In FIG. 4, the hopper 4 oscillates with a oscillation fulcrum (not illustrated) as a center, in such a manner that the hopper 4 allows the paper sheet P supported by the hopper 4 to move forward or rearward in relation to a feeding roller 5. The hopper 4 moves upward, in such a manner that the uppermost paper sheet of the paper sheets P in a set state comes into contact with the feeding roller 5. Then, the uppermost paper sheet is fed to a downstream side in accordance with rotation of the feeding roller 5.

A paper transport unit including the transport driving roller 16 and the transport driven roller 15 is provided in an area downstream from the feeding roller 5. The paper sheet P is transported to an area below an ink jet recording head 21 by the rollers. The transport driving roller 16 is rotationally driven by a motor 32 (see FIGS. 15 and 16) as a driving source. The transport driven roller 15 is rotationally and pivotally supported by a roller shaft support member 14. The transport driven roller 15 is pressed to the transport driving roller 16 by a biasing unit (not illustrated) which applies a pushing force to the roller shaft support member 14. The transport driven roller 15 comes into contact with the transported paper sheet P, and thus the transport driven roller 15 is rotationally driven. The transport driving roller 16 is constituted of a metal solid shaft or a metal hollow shaft. The transport driven roller 15 is constituted of, for example, a resin material (such as polyoxymethylene (POM)). Furthermore, the details of the transport driving roller 16 and the transport driven roller 15 will be described below.

The ink jet recording head 21 is provided in the carriage 17. Ink cartridge 20 is mounted on the carriage 17. The carriage 17 receives power from a motor 47 (see FIGS. 2 and 3) and reciprocates in the paper width direction (in other words, the x direction). In the embodiment, in a movement area (in other words, a movement range) of the carriage 17, the right end of FIGS. 2 and 3 is a home position of the carriage 17. In this case, the home position means a standby position of the carriage 17 during a non-printing period or a power-off period.

Hereinafter, a movement direction of the carriage 17 when the carriage 17 moves from the right end (in other words, the home position) to the left end is set to a second direction. Furthermore, a movement direction of the carriage 17 when the carriage 17 moves from the left end to the right end is set to a first direction.

Next, a casing body of the carriage 17 is constituted of a carriage main body 18 having a box shape. Ink cartridges 20A and 20B are mounted on the inner side of the carriage main body 18. Ink is supplied from the ink cartridges 20A and 20B to the ink jet recording head 21. The ink cartridges 20A and 20B can be mounted or removed to or from the carriage main body 18. In FIGS. 7 and 9 to 11, the reference numerals and letters 19A and 19B respectively indicate levers which release locking of the ink cartridges 20A and 20B in relation to the carriage main body 18.

Furthermore, in the embodiment, the carriage 17 is a so-called on-carriage type in which the ink cartridges 20A and 20B are mounted on the carriage 17. However, the carriage 17 may be a so-called off-carriage type in which the ink cartridges 20A and 20B are provided separated from the carriage and the ink cartridges 20A and 20B and the recording head 21 are connected through an ink tube.

In FIG. 4, the carriage main body 18 has a first supported portion 18*a* on the front side of the apparatus and has a second supported portion 18*b* on the rear side of the apparatus. The first supported portion 18*a* is supported by the guide frame 13 as a "second frame material" and the second supported portion 18*b* is supported by a guide frame 12 as a support member and a "first frame material". In other words, the carriage 17 is supported by the guide frame 13 and the guide frame 12 which extend in the movement direction (that is, the x direction) of the carriage 17. In addition, the first supported portion 18*a* is supported by the guide frame 13 and the first supported portion 18*a* slides on the guide frame 13.

Similarly, the second supported portion 18*b* is supported by the guide frame 12 and the second supported portion 18*b* slides on the guide frame 12. Furthermore, the guide frame 12 defines the y-direction position of the carriage 17. In other words, the guide frame 12 guides the carriage 17 in a main scanning direction. The details of the first supported portion 18*a*, the second supported portion 18*b*, and guide frames 12 and 13 will be described below.

Next, the paper support member 22 supporting the paper sheet P is provided at a position facing the ink jet recording head 21. A gap between the paper sheet P and the ink jet recording head 21 is defined by the paper support member 22. A discharge driving roller 25 and a discharge driven roller 26 which discharge the paper sheet P subjected to recording are provided in an area downstream from both the ink jet recording head 21 and the paper support member 22. The reference numeral and letter 25*a* indicates a rotation shaft of the discharge driving roller 25. A plurality of discharge driving rollers 25 is provided, at appropriately intervals, along an axial direction of the 25*a* (see FIGS. 2 and 3). In addition, the reference numeral 24 indicates a regulation roller which regulates floating of a paper sheet.

Next, frames constituting the framework of the apparatus main body 2 will be described. In FIGS. 2, 3, and 21, the main frame 8, the sub-frame 11, the guide frames 12 and 13 have a shape extending in the paper width direction (in other words, the x direction) and the side frames 9 and 10 have a shape extending in the paper transport direction. FIGS. 3 and 21 illustrate a state where the sub-frame 11 is removed from a condition illustrated in FIG. 2 and the guide frame 13 is exposed.

The main frame 8 extends in an up-down direction such that, in a cross-sectional view, the main frame 8 has a shape as illustrated in FIG. 4. An upper portion of the main frame 8 is bent to the rear side of the apparatus so that the upper portion thereof is formed in an L shape. A lower portion of the main frame 8 is bent to the front side of the apparatus so that the lower portion thereof is formed in an L shape. A paper feeding unit including the hopper 4 and the feeding roller 5 are attached to the main frame 8. In addition, various components, such as the motor 47 for driving the carriage 17 and the roller shaft support member 14 for supporting the transport driven roller 15 are installed in the main frame 8.

In a cross-sectional view, the guide frame 12 extends in the up-down direction, as illustrated in FIG. 4. The lower portion of the guide frame 12 is bent to the front side of the apparatus. Next, the guide frame 12 is bent to the upper side. Next, the guide frame 12 is bent to the rear side of the apparatus. As a result, the guide frame 12 is formed in a hook-like shape. More specifically, in the cross-sectional view of FIG. 5, the reference numeral and letter 12*a* indicates a part of the guide frame 12, which is a portion (hereinafter, referred to as a "vertical portion 12*a*") extending in the up-down direction. The reference numeral and letter 12*b* indicates a part of the guide frame 12, which is a portion (hereinafter, referred to as a "horizontal portion 12*b*") extending in a horizontal direction. The reference numeral and letter 12*c* indicates a part of the guide frame 12, which is a portion (hereinafter, referred to as a "second vertical portion 12*c*") extending in the up-down direction. The reference numeral and letter 12*d* indicates a part of the guide frame 12, which is a portion (hereinafter, referred to as a "second horizontal portion 12*d*") extending in the horizontal direction. In a cross-sectional view, the guide frame 12 is formed in a hook-like shape, as described above, and thus the rigidity of the guide frame 12 in a longitudinal direction (in other words, the paper width direction) can be increased.

In this case, an upper surface 12*e* of the horizontal portion 12*b* of the guide frame 12 is a slide surface on which a slider 18*c* (see FIGS. 8 and 10) provided in the carriage main body 18 slides. Furthermore, sliders 18*d* and 18*e* are provided in the carriage main body 18. The sliders 18*d* and 18*e* are provided in a state where the slider 18*d* can move forward or rearward in relation to the slider 18*e* and the slider 18*d* is pressed to the slider 18*e* side. Accordingly, it is configured so that the second vertical portion 12*c* is interposed between the slider 18*d* and the slider 18*e*. In addition, the sliders 18*d* and 18*e* and the second vertical portion 12*c* slide in accordance with a movement operation of the carriage 17. The reference numeral and letter 12*f* indicates a slide surface on which the slider 18*d* slides. The reference numeral and letter 12*g* indicates a slide surface in which the slider 18*e* slides. Accordingly, it is preferable that the surfaces of the slide surfaces 12*e*, 12*f*, and 12*g* are smooth.

In a cross-sectional view, the guide frame 13 provided on the front side of the apparatus extends in the horizontal direction, as illustrated in FIG. 4. A part of the guide frame 13, which is an end portion on the front side of the apparatus, is bent upward. Next, the part of the guide frame 13 is bent to the rear side of the apparatus, in the horizontal direction. Thus, the guide frame 13 is formed in a hook-like shape. More specifically, in the cross-sectional view of FIG. 6, the reference numeral and letter 13*a* indicates a part of the guide frame 13, which is a portion (hereinafter, referred to as a "horizontal portion 13*a*") extending in the horizontal direction. The reference numeral and letter 13*b* indicates a part of the guide frame 13, which is a portion (hereinafter, referred to as a "vertical portion 13*b*") extending in the vertical direction. The reference numeral and letter 13*c* indicates a part of the guide frame 13, which is a portion (hereinafter, referred to as a "second horizontal portion 13*c*") extending in the horizontal direction. In a cross-sectional view, the guide frame 13 is formed in a hook-like shape, as described above, and thus the rigidity of the guide frame 13 in a longitudinal direction (in other words, the paper width direction) can be increased.

An upper surface (to which the reference numeral and letter 13*d* is given) of the horizontal portion 13*a* of the guide frame 13 is a slide surface on which the first supported portion (that is, a slider) 18*a* (see FIGS. 8 and 10) provided in the carriage 17 slides. Accordingly, it is preferable that the slide surface 13*d* is smooth.

Next, returning to FIGS. 2, 3, and 21, the side frames 9 and 10 are respectively in contact with end portions of the guide frames 12 and 13. Various components, such as the transport driving roller 16, the discharge driving roller 25, and the paper support member 22 which are described with reference to FIG. 2, forming the paper transport path are installed in the side frames 9 and 10. Furthermore, a left end portion 22*a* of the paper support member 22 is fixed to the side frame 10 by a screw (not illustrated) and a right end portion 22*b* thereof is fixed to the side frame 9 by screws 52 and 52, as illustrated in FIG. 21. In other words, x-direction end portions of the paper support member 22 are supported by the side frames 9 and 10.

In addition, in the paper support member 22, a center portion 22*c* located slightly closer to a center portion than the right end portion 22*b* is fixed to the main frame 8 by a screw 51. In other words, x-direction end portions of the paper support member 22 are supported by the side frames 9 and 10 and, further, a portion between the x-direction end portions is supported by the main frame 8. Accordingly, bending (drooping) of the paper support member 22 in the x direction can be effectively prevented. Furthermore, the function of the paper support member 22 will be described below.

Subsequently, the carriage 17 (in other words, the carriage main body 18) according to the embodiment will be described with reference to FIGS. 7 and 23B. In the carriage 17, the carriage main body 18 which has a box shape, as described above, constitutes a casing body. In FIG. 9, the reference numeral and letter 18*h* indicates a side surface (hereinafter, referred to as a "left side surface") on the second direction side, among side surfaces constituting the periphery of the carriage main body 18. In FIG. 10, the reference numeral and letter 18*g* indicates a side surface (hereinafter, referred to as a "right side surface") on the first direction side.

Furthermore, in FIGS. 7 to 9 and 11, a reference numeral and letter 18*f* indicates a protrusion portion protruding in the second direction (which is a direction leading to a position opposite to the home position of the carriage 17). In the carriage main body 18, a protrusion portion 18*f* is a portion in an area A illustrated in FIGS. 7 and 8. In the embodiment, the protrusion portion 18*f* means a portion protruding from the second supported portion 18*b* to the second-direction side.

More specifically, in FIG. 8, a straight line Cu is a line which passes through a central position between two sliders 18*c* and 18*c* disposed in a carriage movement direction at a predetermined interval and is parallel to the y direction. A range Ws indicates a supported area in which the second supported portion 18*b* is supported by the guide frame 12 as a support unit. The protrusion portion 18*f* is formed in the carriage main body 18, and thus the carriage main body 18 is asymmetric in the carriage movement direction (in other words, the x direction), with respect to the straight line Cu passing through the central position of the supported range Ws.

The reference letter At indicates a triangular area surrounded by straight lines passing through the two sliders 18*c* and 18*c* and the first supported portion (slider) 18*a*. In a cross-sectional view, the centroid of the carriage 17 is located in an area At.

Subsequently, a belt clamp portion 18*k* is provided on the rear side of the carriage main body 18, as illustrated in FIG. 11. The belt clamp portion 18*k* is a portion for clamping (gripping) an endless belt 48. The belt clamp portion 18*k* receives a driving force from the endless belt 48. The endless belt 48 extends over the entirety of the carriage movement area. The endless belt 48 is driven by receiving power from the motor 47 (see FIGS. 2 and 3) and moves the carriage 17.

Next, both the transport driving roller 16 constituting the transport unit for transporting the paper sheet P and the gear group 33 as a power transmission mechanism for transmitting power from the motor 32 (see FIGS. 15 and 16) to the discharge driving roller 25 will be described. The motor 32 is provided on the rear side in a front-rear direction of the apparatus. The gear group 33 includes a plurality of gears so that the gear group 33 transmits power to both the transport driving roller 16 located at a central position in the front-rear direction of the apparatus and the discharge driving roller 25 (in other words, a rotation shaft 25*a* thereof) located on the front side in the front-rear direction of the apparatus.

The respective gears constituting the gear group 33 are provided in the side frame 10. More specifically, the gears are provided outside (outside the apparatus) the side frame 10. The gear group 33 is constituted of gears 34, 35, 36, 37, 38, 39, 40, and 41 and the gears are arranged in order from the motor 32 side, as illustrated in FIGS. 15 and 16. The gear 34 is a gear provided in the rotation shaft of the motor 32. The gear 37 is a gear (in other words, a first roller driving gear) provided in an axial end of the transport driving roller 16 as a first roller. The gear 41 is a gear (in other words, a second roller driving gear) provided in an axial end of the discharge driving roller 25 (in other words, the rotation shaft 25*a* thereof) as a second roller. The gear group 33 transmits power to the discharge driving roller 25 (in other words, the rotation shaft 25*a* thereof) through the gear 37.

The rotary scale 45, in addition to the gear 37, is provided in the axial end of the transport driving roller 16 (see FIGS. 13 and 14). The rotary scale 45 constitutes a rotation detection unit 43 which detects rotation of the transport driving roller 16. A detector 44 (see FIG. 16) for detecting rotation of the rotary scale 45 is provided in a state where the detector 44 pinches the outer circumferential portion of the rotary scale 45. The rotary scale 45 and the detector 44 constitute the rotation detection unit 43. A controller (not illustrated) of the printer 1 can check the rotation amount and the rotation direction of both the transport driving roller 16 and the discharge driving roller 25, using a detection signal from the rotation detection unit 43.

In the configuration described above, FIGS. 12 and 16 illustrate a state where the carriage 17 is located at the position of the end portion in the second direction. In the embodiment, among the gears constituting the gear group 33, the entirety of the gears 38 and 39 are located below the carriage 17 and the gears 37 and 40 are partially located below the carriage 17, as illustrated in FIGS. 12 and 16.

At least a part of the gear group 33 is located below the carriage 17 in a state where the carriage 17 is moved to the end portion in the second direction, as described above. Accordingly, it is configured so that the gear group 33 is disposed in an area necessary for the movement of the carriage 17. As a result, the size of the width of the apparatus can be reduced. In addition, the size of the width of the apparatus can be reduced even when the width of the carriage 17 is ensured. Thus, the volume of the carriage 17, in other words, the volume of the ink cartridges 20A and 20B can be ensured.

Furthermore, in the embodiment, the carriage 17 includes the protrusion portion 18*f* protruding in the second direction. Accordingly, the volume of the carriage 17 can be ensured by the protrusion portion 18*f* and at least a part of the gear group 33 is disposed below the protrusion portion 18*f* of the carriage 17 in a state where the carriage 17 is moved to the end portion in the second direction. As a result, an increase in the size of the width of the apparatus can be prevented. Furthermore, the volume of the carriage can be ensured without an increase of the size of the carriage main body 18 in the height direction, and thus an increase in the size of the apparatus in the height direction can be prevented.

In addition, in the carriage 17, the ink cartridge 20B occupies a space including the protrusion portion 18*f*, and thus the ink capacity of the ink cartridge 20B can be ensured.

In the embodiment, the diameter of the rotary scale 45 constituting the rotation detection unit 43 for detecting rotation of the transport driving roller 16 as the first roller is set to be smaller than that of the gear 37 as a first roller driving gear. Accordingly, the rotary scale 45 can be protected from an external pressure applied from, particularly, the upper side of the apparatus. Furthermore, the rotary scale 45 is provided on a first-direction side (in other words, a side frame 10 side) in relation to the gear 37. Accordingly, the detector 44 sensing the rotary scale 45 is also disposed in a portion between the gear group 33 and the side frame 10. As a result, the detector 44 can be prevented from being disposed in the outermost side (in other words, the outer side in the carriage movement direction) of the apparatus main body, and thus an increase in the size (in other words, the size in the carriage movement direction) of the apparatus main body can be prevented.

In addition, the rotary scale 45 is weak in terms of strength and, further, the detection accuracy thereof is easily reduced due to a small amount of distortion, and thus this leads to a reduction in recording quality. However, in the embodiment, the rotary scale 45 is provided on the first-direction side (in other words, the side frame 10 side) in relation to the gear 37 as the first roller driving gear. Thus, both the rotary scale 45 and the detector 44 can be protected from an external pressure applied from the lateral side of the apparatus.

Furthermore, a convex portion 10*a* which extends along the external appearance of the rotary scale 45 and is formed in an arc shape of which the diameter is larger than that of the rotary scale 45 is formed in the side frame 10 which supports the transport driving roller 16, as illustrated in FIG. 13. Accordingly, the convex portion 10*a* has a shielding function in relation to the rotary scale 45, and thus ink mist can be prevented from adhering to the rotary scale 45.

Furthermore, in the carriage main body 18, a concave portion 18*j* to which the convex portion 10*a* is disposed when the carriage 17 is located at the position of the end portion in the second direction (see FIG. 11). In other words, when the carriage 17 is located at the position of the end portion in the second direction (in other words, the carriage 17 is in a state illustrated in FIG. 12), the convex portion 10*a* is inserted into the concave portion 18*j*. Accordingly, it is not necessary to set the position of the side frame 10 to the outside in order to ensure the movement area of the carriage 17 (in order to prevent the interference between the carriage main body 18 and the side frame 10). As a result, an increase in the size of the width of the apparatus can be prevented.

The embodiment described above is an example. Needless to say, the invention is not intended to be limited by the embodiment described above. FIG. 17A, for example, is a view which schematically illustrates the embodiment described above. When the carriage main body 18 moves in the arrow direction from the position illustrated by the two-dot chain line and is located at the position of the outermost end portion, the gear 37 completely enters an area below the carriage main body 18, in the carriage movement direction (in other words, the x direction). However, the configuration is not limited thereto. It may be configured so that a part of the gear (to which the reference numeral 37' is given) enters an area below the carriage main body 18, in the carriage movement direction (in other words, the x direction), as illustrated in FIG. 17B. Furthermore, the broken line to which a reference letter Ln is given illustrates the position of the left side surface of the carriage main body 18. In addition, the reference numeral and letter 18*m* indicates a concave portion which is formed in the left side of the lower portion of the carriage main body 18. A concave portion 18*m* is a concave portion which is formed, by the protrusion portion 18*f* described above, below the protrusion portion 18*f*.

Furthermore, a carriage main body 18' illustrated in FIG. 18 is formed in a symmetric shape in the carriage movement direction (in other words, the x direction), unlike in the case of the embodiment described above. In other words, the size of the concave portion 18*m* and the size of a concave portion 18*n* are the same. It can be configured so that, when the carriage main body 18' having such a shape is located at the position of the end portion in the movement direction, the gear 37 is inserted into the concave portion 18*m*.

In addition, application examples as described below can also be applied. In the embodiment, the carriage 17 is supported by, for example, the guide frames 12 and 13 and is guided in the movement direction by the frames. However, the carriage 17 may be supported by a shaft and is guided in the movement direction by the shaft.

Subsequently, the details of the transport driving roller 16 and the transport driven roller 15 will be described with reference to FIGS. 19 to 23B. In FIG. 19, the transport driving roller 16 includes a high friction layer 16*a* which is formed by substantially evenly dispersing wear resistance particles in the outer circumferential surface of a shaft body (constituted of a metal solid shaft or a metal hollow shaft) extending in the paper width direction. Right and left axial ends of the transport driving roller 16 are supported by the side frames 9 and 10 (see FIG. 2).

The high friction layer 16*a* is not formed in a center portion of the transport driving roller 16. The center portion is supported by the central support member 50, as illustrated by FIGS. 19 and 20. Not only the both end portions of the transport driving roller 16 but also the center portion of the transport driving roller 16 are supported by the central support member 50. As a result, bending of the transport driving roller 16 is prevented, and thus favorable paper transporting accuracy can be ensured.

The central support member 50 is provided in the paper support member 22. In FIG. 20, the reference numeral and letter 22*d* indicates a support portion which supports the central support member 50 in the paper support member 22. The central support member 50 supporting the center portion of the transport driving roller 16 is provided (supported) in the paper support member 22, as described above. Thus, the shape and the amount of bending (in other words, drooping of the center portion) of the central support member 50 in the x direction can be substantially the same as those of the transport driving roller 16.

Accordingly, the relative positional relationship between the paper support member 22 and the transport driving roller 16 does not vary in the x direction (in other words, the paper width direction). In other words, the posture of a paper sheet is stabilized in the x direction (in other words, the paper width direction), and thus a reduction in recording quality can be prevented.

The paper support member 22 is in a state where the end portions of the paper support member 22 in the x direction are supported by the side frames 9 and 10 and the center portion 22*c* between the end portions is also supported by the main frame 8, as described with reference to FIG. 21. Accordingly, bending (drooping) of the paper support member 22 in the x direction can be effectively prevented. As a result, bending (drooping of the center portion) of the transport driving roller 16 can be also effectively prevented, and thus more a favorable recording quality can be obtained. In addition, a gap between the recording head 21 and the paper sheet P is also stabilized in the x direction (in other words, the paper width direction), and thus a reduction in the recording quality can be prevented.

Next, the positional relationship between the transport driving roller 16, the transport driven roller 15, and the guide frame 12 will be described.

In FIG. 20, the reference letter and numeral Y1 indicates an occupancy range of the transport driving roller 16 in the paper transport direction (in other words, the y direction). The reference letter and numeral Y2 indicates an occupancy range of the transport driven roller 15 in the paper transport direction (in other words, the y direction). The reference letter and numeral Y3 indicates an occupancy range of the guide frame 12 in the paper transport direction (in other words, the y direction).

In the printer 1 according to the embodiment, the transport driving roller 16 is located below the guide frame 12 which is a support member supporting the carriage 17 and is located in the area of the guide frame 12 in the paper transport direction (in other words, the y direction), as can be understood from FIG. 20. More specifically, the entirety of an occupancy range Y1 of the transport driving roller 16 in the paper transport direction (in other words, the y direction) is located in the occupancy range Y3 of the guide frame 12 in the paper transport direction (in other words, the y direction).

Accordingly, the size of the transport driving roller 16 and the size of the guide frame 12 are not separately added in terms of the size of the apparatus in the paper transport direction (in other words, the y direction), and thus the size of the apparatus in the paper transport direction (in other words, the y direction) can be reduced.

Furthermore, the recording head 21 and the components in the vicinity of the recording head 21 can be located close to the upstream side (in other words, the right side in FIG. 4) in the transport direction, and thus the size (in other words, the y-direction size) of the apparatus in the depth direction can be reduced.

In the embodiment, the transport driven roller 15 is located below the guide frame 12 and is located, in the paper transport direction (in other words, the y direction) in the area of the guide frame 12. The transport driving roller 16 is located below the transport driven roller 15 and is located, in the paper transport direction (in other words, the y direction), in the area of the transport driven roller 15. More specifically, the entirety of the occupancy range Y2 of the transport driven roller 15 in the paper transport direction (in other words, the y direction) is located in the occupancy range Y3 of the guide frame 12 in the paper transport direction (in other words, the y direction). Furthermore, the entirety of the occupancy range Y1 of the transport driving roller 16 in the paper transport direction (in other words the y direction) is located in the occupancy range Y2 of the transport driven roller 15 in the paper transport direction (in other words, the y direction).

Accordingly, the size of the transport driving roller 16, the size of the transport driven roller 15, and the size of the guide frame 12 are not separately added in terms of the size of the apparatus in the paper transport direction (in other words, the y direction), and thus the size of the apparatus in the paper transport direction (in other words, the y direction) can be more favorably reduced.

In the embodiment, at least a part of the guide frame 12 and at least a part of the roller shaft support member 14 which pivotally supports the transport driven roller 15 are located at the same vertical position. More specifically, in FIG. 20, the reference numeral and letter 14*a* indicates a notched portion which is formed in the roller shaft support member 14 and of which the depth is Z1. The lower portion (and the lower portion of the main frame 8) of the guide frame 12 are inserted into a notched portion 14*a* having the depth Z1.

Accordingly, the size of the roller shaft support member 14 and the size of the guide frame 12 are not separately added in terms of the size of the apparatus in the height direction, and thus the size of the apparatus in the height direction can be reduced.

In the embodiment, the guide frames 12 and 13 as the support member for supporting the carriage 17 are constituted of a frame material. Here, when it is assumed that the support member is constituted of a shaft body, it is necessary to provide a bearing to receive the shaft body. Thus, the size of the apparatus in the movement direction (in other words, the x direction) of the carriage 17 is increased by the size of the bearing. However, in the embodiment, the guide frames 12 and 13 as the support member are constituted of the frame material, and thus an increase in the size of the apparatus in the movement direction (in other words, the x direction) of the carriage 17 can be prevented.

In the embodiment, the carriage 17 is supported by the guide frames 12 and 13 and the discharge driving roller 25 as the discharge roller is located below the guide frame 13. Accordingly, the size of the discharge driving roller 25 and the size of the guide frame 13 are not separately added in terms of the size of the apparatus in the transport direction (in other words, the y direction) of a medium, and thus the size of the apparatus in the transport direction (in other words, the y direction) of the medium can be reduced.

Subsequently, FIG. 22 is a view illustrating a positional relationship between the transport driving roller 16 and the transport driven roller 15. The reference letter and numeral Q1 indicates a central position of the shaft of the transport driven roller 15. The reference letter and numeral Q2 indicates a central position of the shaft of the transport driving roller 16. Furthermore, the reference letter T indicates a contact position between the transport driving roller 16 and the transport driven roller 15. The reference letter Lv indicates a vertical line passing through a shaft center position Q2. The reference letter Lp indicates a straight line passing through both a shaft center position Q1 and the shaft center position Q2. The reference letter Lh indicates a horizontal line passing through a contact position T. Furthermore, the reference letter a indicates an angle between the vertical line Lv and the straight line Lp. The reference letter and numeral d1 indicates the diameter of the transport driven roller 15 and the reference letter and numeral d2 indicates the diameter of the transport driving roller 16.

In the embodiment, a diameter d1 of the transport driven roller 15 is set to be larger than a diameter d2 of the transport driving roller 16. Furthermore, an angle $\alpha$ is set to a value of $0° < \alpha < 90°$, and thus a feeding direction of the paper sheet P which is sent from a portion between the transport driving roller 16 and the transport driven roller 15 leads to a obliquely lower side, as illustrated by an arrow Df. Therefore, the paper sheet P sent from the portion between the transport driving roller 16 and the transport driven roller 15 is pressed to the paper support member 22 (see FIG. 4). As a result, floating of the paper sheet is prevented at the position facing the recording head 21, and thus a favorable recording result can be obtained.

Hereinafter, an operation effect obtained by the configuration in which the diameter d1 of the transport driven roller 15 is set to be larger than the diameter d2 of the transport driving roller 16 will be described with reference to FIGS. 23A and 23B. For convenience of description, in the illustration of FIGS. 23A and 23B, the angle α illustrated in FIG. 22 is set to zero degrees. However, practically, the angle α is set to certain degrees, as illustrated in FIG. 22.

In FIG. 23A illustrating the embodiment, the reference letter Cu indicates a part of the following edge of a paper sheet, which is a corner portion pushed out by the transport driven roller 15. The reference letter Cd indicates a part of the following edge of a paper sheet, which is a corner portion pushed out by the transport driving roller 16.

The transport driven roller 15 is pressed to the transport driving roller 16. In other words, the paper sheet P is pressed in a portion between the transport driven roller 15 and the transport driving roller 16. Accordingly, when the following edge of the paper sheet is discharged from both rollers, the following edge receives a pushing force from both rollers. The reference letter and numeral F1 indicates a pushing force applied from the transport driven roller 15 to a following edge corner portion Cu and the reference letter and numeral F2 indicates a pushing force applied from the transport driving roller 16 to a following edge corner portion Cd. In the embodiment, a pushing force F2 by the transport driving roller 16 having a relatively small diameter is larger than a pushing force F1 by the transport driven roller 15 having a relatively large diameter.

In this case, when the following edge of the paper sheet is pushed out from the portion between the transport driven roller 15 and the transport driving roller 16, rotation R2 of the transport driven roller 15 is free rotation and the rotation acts on the following edge of the paper sheet so that the rotation causes the following edge to be forcefully pushed out. However, the transport driving roller 16 is connected to a power source and cannot freely rotate. Thus, rotation R1 of the transport driving roller 16 acts on the following edge of the paper sheet so that the rotation R1 does not cause the following edge to be forcefully pushed out, compared to the rotation R2 of the transport driven roller 15.

In the embodiment, the property described above is used. Accordingly, the diameter of the transport driven roller 15 which is operated so that the transport driven roller 15 forcefully pushes out the following edge of the paper sheet is set to be larger than that of the transport driving roller 16 so that the amount of the pushing force F1 in accordance with pressing is relatively small (d1>d2). As a result, a kick-off phenomenon can be appropriately prevented with a simple configuration.

For a comparison between the embodiment and the related art, FIG. 23B shows a view illustrating a case where a diameter of a transport driven roller 15' is set to be smaller than that of a transport driving roller 16'. In this case, the pushing force F1 is larger than the pushing force F2, as illustrated in the accompanying drawing. Accordingly, the transport driven roller 15 rotates (can freely rotate) so that the transport driven roller 15 forcefully pushes out the following edge of the paper sheet in accordance with the relatively large pushing force F1. As a result, a kick-off phenomenon is significant.

Furthermore, the diameter d1 of the transport driven roller 15 is set to be larger than the diameter d2 of the transport driving roller 16, and thus an influence of a reduction in assembling accuracy of the apparatus can be reduced. In other words, as described with reference to FIG. 22, the angle α is set, and thus the feeding direction of the paper sheet P sending from the portion between the transport driving roller 16 and the transport driven roller 15 leads to a obliquely lower side, as illustrated by an arrow Df. The angle α is important in view of achieving a favorable recording quality.

However, when the position of the transport driven roller 15 moves in the horizontal direction due to a reduction in the assembling accuracy of the transport driven roller 15, the angle α also changes. The smaller the diameter d1 of the transport driven roller 15 is, the larger the change rate of the angle α. However, in the embodiment, the diameter d1 of the transport driven roller 15 is set to a large value, and thus variation of the angle α in accordance with variation of the position of the transport driven roller 15 is suppressed. As a result, a favorable recording quality can be obtained.

Furthermore, the rotary scale 45 (see FIGS. 13 and 14) is installed in the shaft end of the transport driving roller 16, as described above. In the embodiment, the diameter of the transport driving roller 16 is set to be smaller than that of the transport driven roller 15, and thus the diameter of the rotary scale 45 can also be set to a small value. Accordingly, the vertical position of the transport driving roller 16 can be lowered, and thus the size of the apparatus in the height direction can be reduced. As a result, the rotary scale 45 is disposed below the carriage 17, in a state where the carriage 17 is located at the position of the end portion in the second direction, as illustrated in FIGS. 12 and 16. In other words, it is configured so that the rotary scale 45 is disposed within the area necessary for the movement of the carriage 17. As a result, the size of the apparatus in the width direction can be reduced.

The entire disclosure of Japanese Patent Application No. 2014-130393, filed Jun. 25, 2014 is expressly incorporated by reference herein.

What is claimed is:

1. A recording apparatus comprising:

a carriage which includes a recording head performing recording on the medium and can move in a predetermined direction;

a support member which extends in a carriage movement direction and supports the carriage;

a transportation driving roller that transports the medium to the recording head;

a feeding roller for feeding the medium that has been loaded in a medium feed tray and feeds the medium to the transportation driving roller;

a driving source that drives the transportation driving roller;

a transportation driven roller which is pressed to the transportation driving roller and is rotationally driven in contact with the medium; and a projection portion which projects towards the feeding roller at an upper part of the support member;

wherein the support member is formed in a portion between the feeding roller and the carriage, wherein a part of the projection portion partially surrounds the feeding roller such that the part of the first projection is disposed above the feeding roller, wherein the transportation driving roller is located below the support member and located in an area of the support member in a medium transport direction, and wherein an outer circumference of the transportation driven roller is lamer than that of the transportation driving roller.

2. The recording apparatus according to claim 1, further comprising:

a roller shaft support member which pivotally supports the driven roller, wherein at least a part of the support member and at least a part of the roller shaft support member are located at the same vertical position.

3. The recording apparatus according to claim 2, wherein the support member constitutes a periphery of a movement area of the carriage.

4. The recording apparatus according to claim 2, further comprising:

a discharge roller which is located downstream from the recording head in a medium transport direction and discharges the medium, wherein the carriage has the support member used as a first frame material and is supported by the first frame material and a second frame material which is disposed downstream from the recording head in the medium transport direction, and wherein the discharge roller is located below the second frame material.

5. The recording apparatus according to claim 1, wherein the support member constitutes a periphery of a movement area of the carriage.

6. The recording apparatus according to claim 1, further comprising:

a discharge roller which is located downstream from the recording head in a medium transport direction and discharges the medium, wherein the carriage has the support member used as a first frame material and is supported by the first frame material and a second frame material which is disposed downstream from the recording head in the medium transport direction, and wherein the discharge roller is located below the second frame material.

* * * * *